US010695628B1

(12) United States Patent
Yi et al.

(10) Patent No.: US 10,695,628 B1
(45) Date of Patent: Jun. 30, 2020

(54) GOLF CLUB HAVING AN ADJUSTABLE WEIGHT ASSEMBLY

(71) Applicant: Acushnet Company, Fairhaven, MA (US)

(72) Inventors: Sang Yi, Carlsbad, CA (US); Thomas Orrin Bennett, Carlsbad, CA (US); Stephen S. Murphy, Carlsbad, CA (US); Richard L. Cleghorn, Oceanside, CA (US); Peter Larsen, San Marcos, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 0 days.

(21) Appl. No.: 16/387,859

(22) Filed: Apr. 18, 2019

(51) Int. Cl.
*A63B 53/06* (2015.01)
*A63B 53/08* (2015.01)
*A63B 53/04* (2015.01)

(52) U.S. Cl.
CPC ..... *A63B 53/08* (2013.01); *A63B 53/06* (2013.01); *A63B 53/047* (2013.01); *A63B 53/0466* (2013.01); *A63B 2053/045* (2013.01); *A63B 2053/0437* (2013.01); *A63B 2053/0491* (2013.01)

(58) Field of Classification Search
USPC ..... 473/324–350
See application file for complete search history.

(56) References Cited

U.S. PATENT DOCUMENTS

| | | | | |
|---|---|---|---|---|
| 4,085,934 | A * | 4/1978 | Churchward | A63B 53/04 473/338 |
| 6,409,612 | B1 * | 6/2002 | Evans | A63B 53/04 473/324 |
| 6,592,468 | B2 * | 7/2003 | Vincent | A63B 53/047 473/334 |
| 6,663,505 | B1 * | 12/2003 | Solari | A63B 53/0487 473/334 |
| 7,108,609 | B2 | 9/2006 | Stites | |
| 7,121,956 | B2 | 10/2006 | Lo | |
| 7,166,041 | B2 | 1/2007 | Evans | |
| 7,611,424 | B2 | 11/2009 | Nagai | |

(Continued)

FOREIGN PATENT DOCUMENTS

| | | | |
|---|---|---|---|
| JP | 01043278 A * | 2/1989 | |
| JP | 2005296582 | 10/2005 | |

(Continued)

*Primary Examiner* — Alvin A Hunter

(57) ABSTRACT

A golf club head includes a body having an outer surface with a recessed channel formed therein. A weight assembly that includes a weight at least partially disposed within the recessed channel, a cover extending over the recessed channel, and a fastener coupling the cover to the body. The fastener is adapted to retain the weight in the recessed channel only indirectly by the cover. The weight assembly is positionable in an unlocked configuration and a locked configuration. When the weight assembly is in the unlocked configuration, the cover is lifted out of the recessed channel and the weight is selectively slidable within the recessed channel. When the weight assembly is in the locked configuration, the cover is disposed within the recessed channel and the weight is secured within the recessed channel. The weight assembly is coupled to the body in both the unlocked configuration and the locked configuration.

20 Claims, 21 Drawing Sheets

(56) References Cited

U.S. PATENT DOCUMENTS

| | | | | |
|---|---|---|---|---|
| 7,775,905 | B2 | 8/2010 | Beach | |
| 7,806,782 | B2 | 10/2010 | Stites | |
| 7,871,339 | B2 | 1/2011 | Sanchez | |
| 8,016,694 | B2 | 9/2011 | Llewellyn | |
| 8,043,167 | B2 | 10/2011 | Boyd | |
| 8,192,303 | B2 | 6/2012 | Ban | |
| 8,202,175 | B2 | 6/2012 | Ban | |
| 8,444,505 | B2 | 5/2013 | Beach | |
| 8,696,491 | B1 | 4/2014 | Myers | |
| 8,790,195 | B1 | 7/2014 | Myers | |
| 8,894,506 | B1 | 11/2014 | Myers | |
| 8,968,116 | B1 | 3/2015 | Myers | |
| 9,211,453 | B1 | 12/2015 | Foster et al. | |
| 9,259,627 | B1 * | 2/2016 | Myers | A63B 53/04 |
| 9,289,660 | B1 * | 3/2016 | Myers | A63B 53/06 |
| 9,364,728 | B1 * | 6/2016 | Myers | A63B 53/06 |
| 9,597,561 | B1 | 3/2017 | Seluga | |
| 9,623,302 | B1 * | 4/2017 | Myers | A63B 53/06 |
| 9,694,256 | B2 * | 7/2017 | Myers | A63B 53/0466 |
| 9,694,261 | B2 | 7/2017 | Nunez | |
| 9,731,175 | B1 | 8/2017 | Myers | |
| 10,183,203 | B1 | 1/2019 | Yi et al. | |

FOREIGN PATENT DOCUMENTS

| | | |
|---|---|---|
| JP | 2005323978 | 11/2005 |
| JP | 2006320493 | 11/2006 |
| JP | 2010069106 | 4/2010 |
| JP | 2010136772 | 6/2010 |
| JP | 2010148702 | 7/2010 |
| JP | 2010252964 | 11/2010 |
| JP | 2012125291 | 7/2012 |
| JP | 2012139450 | 7/2012 |
| JP | 2014223548 | 12/2014 |

* cited by examiner

GOLF CLUB HAVING AN ADJUSTABLE WEIGHT ASSEMBLY

BACKGROUND

The flight characteristics of a golf ball after being struck by a golf club are dependent on not only on the swing of the golf club but also on the golf club itself. For example, flight characteristics of the golf ball, such as fades, draws, launch angles, ball spin, and speed are impacted by the design of the golf club. By adjusting one or more design properties of the golf club, the flight characteristics of the golf ball can be improved, thereby increasing golf club performance. In some examples, adjusting a center of gravity (CG) and/or a moment of inertia (MOI) of a head of the golf club through selective weight placement impacts the flight characteristics of the golf ball. However, these adjustable weights need to be both securely attached to the golf club head and selectively moveable. As such, improvements to adjustable weight assemblies for golf club heads are desired.

SUMMARY

In an aspect, the technology relates to a golf club head including: a body including: a striking face including a lower edge and an opposite upper edge; a sole extending from the lower edge; and a crown extending from the upper edge, wherein one or more of the striking face, the sole, and the crown, define an outer surface of the body; a recessed channel formed in the outer surface; and a weight assembly including: one or more weights at least partially disposed within the recessed channel; a cover extending at least partially over the recessed channel; and a fastener coupling the cover to the body, wherein the fastener is adapted to retain the one or more weights in the recessed channel only indirectly by the cover, wherein the weight assembly is positionable in at least an unlocked configuration and a locked configuration, and when the weight assembly is in the unlocked configuration, at least a portion of the cover is lifted out of the recessed channel and the one or more weights are selectively slidable within the recessed channel, and when the weight assembly is in the locked configuration, the cover is disposed within the recessed channel and the one or more weights are secured within the recessed channel, and wherein the weight assembly is coupled to the body in both the unlocked configuration and the locked configuration.

In an example, the recessed channel defines a track that the one or more weights are slidable on, and the fastener is offset from the track. In another example, the recessed channel includes one or more chambers, and the cover includes one or more corresponding projections, and when the weight assembly is in the locked configuration, the one or more projections are engaged within the one or more chambers. In yet another example, the one or more projections are substantially cylindrical, and the one or more cylindrical projections are substantially parallel to the fastener. In still another example, the recessed channel includes one or more cams protruding into the recessed channel, and the cover includes one or more corresponding cutouts, and when the weight assembly is in the unlocked configuration, at least a portion of the cover is supported on the one or more cams, and when the weight assembly is in the locked configuration, the one or more cams are received at least partially within the one or more cutouts. In an example, the recessed channel includes one or more seats protruding into the recessed channel, and the cover includes one or more corresponding notches, and when the weight assembly is in the locked configuration, the one or more seats are engaged with the one or more notches.

In another example, the one or more seats include at least one oblique surface, and the at least one oblique surface is substantially parallel to the fastener. In yet another example, the body includes an interior cavity and one or more support ribs extend within the interior cavity from the recessed channel. In still another example, the recessed channel is defined by a plurality of sidewalls, and when the weight assembly is in the locked configuration, the one or more weights are compressed between at least one of the plurality of sidewalls and the at least one cover. In an example, the cover includes at least about 50% of the sole of the golf club head.

In another aspect, the technology relates to a golf club head including: a body including: a striking face including a lower edge and an opposite upper edge; a sole extending from the lower edge; and a crown extending from the upper edge, wherein one or more of the striking face, the sole, and the crown, define an outer surface of the body; a recessed channel formed in the outer surface; and one or more weights at least partially disposed within the recessed channel; a plurality of covers extending at least partially over the recessed channel; and a fastener coupling the plurality of covers to the body, wherein the fastener is adapted to retain the one or more weights in the recessed channel only indirectly by the plurality of covers, wherein the fastener is positionable in at least an unlocked configuration and a locked configuration, and when the fastener is in the unlocked configuration, at least a portion of the plurality of covers are lifted out of the recessed channel and the one or more weights are selectively slidable within the recessed channel, and when the fastener is in the locked configuration, the plurality of covers are disposed within the recessed channel and the one or more weights are secured within the recessed channel, and wherein the fastener is coupled to the body in both the unlocked configuration and the locked configuration.

In an example, the plurality of covers includes two covers, each cover having a first end engaged with the recessed channel and a second end engaged with the fastener, and the fastener includes a washer engaged with the second end of both of the two covers.

In another aspect, the technology relates to a golf club head including: a striking face including a lower edge and an opposite upper edge; a sole extending from the lower edge; a crown extending from the upper edge, wherein one or more of the striking face, the sole, and the crown, define an outer surface of the golf club head; a recessed channel formed in the outer surface; one or more weights at least partially disposed within the recessed channel, wherein the one or more weights include a groove; and at least one cover coupled to the golf club head and extending at least partially over the recessed channel, wherein a flange extends from the at least one cover, wherein at least a portion of the flange of the at least one cover is received at least partially within the groove of the one or more weights, and wherein the at least one cover is positionable in at least an unlocked configuration and a locked configuration, and when the at least one cover is in the unlocked configuration, the one or more weights are selectively slidable within the recessed channel, and when the at least one cover is in the locked configuration, the one or more weights are secured within the recessed channel.

In an example, at least a portion of the one or more weights form a portion of the outer surface of the golf club head. In another example, when the at least one cover is in the unlocked configuration, at least a portion of the at least one cover is raised out of the recessed channel, and when the at least one cover is in the locked configuration, the at least one cover is disposed within the recessed channel, and the one or more weights moves with the at least one cover between the unlocked configuration and the locked configuration. In yet another example, the one or more weights include an elastomeric material. In still another example, when the at least one cover is in the locked configuration, the elastomeric material at least partially deforms. In an example, when the at least one cover is in the locked configuration, the at least one cover and the recessed channel engages with the elastomeric material.

In another example, the recessed channel is defined by a plurality of walls, and the golf club head further includes an elastomeric material coupled to one or more of the plurality of walls. In yet another example, when the at least one cover is in the unlocked configuration, at least a portion of the at least one cover is raised out of the recessed channel, and when the at least one cover is in the locked configuration, the at least one cover is disposed within the recessed channel, and the one or more weights rotate within the recessed channel when the at least one cover moves between the unlocked configuration and the locked configuration.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

The technologies described herein contemplate a golf club head, such as a fairway metal, driver, or other golf club head, that includes an adjustable weight assembly. Through the weight balance of the golf club head, the flight characteristics of the golf ball can be improved, thereby increasing golf club performance. In the examples described herein, the weight assembly enables for the CG and/or MOI of a head of the golf club to be adjusted through selective weight placement to impact the flight characteristics of the golf ball, such as fades, draws, launch angles, ball spin, and speed.

In examples, the present technologies provide a golf club head with a recessed channel defined therein. A slidable weight is disposed at least partially within the channel and secured therein by a cover and a fastener. The cover is configured to retain the weight within the channel indirectly so that the fastener never engages with the weight. This configuration enables for the size, shape, and/or density of the weight to be defined so that the CG and MOI of the golf club head can be finely tuned. Additionally, the cover includes additional features that increase the structural rigidity of the cover so as to increase securement of the weight within the channel and reduce undesirable rattling or movement during the golf club swing. Furthermore, the weight assemblies described herein allow for the weight to be adjusted quickly and easily without requiring any component to be fully detached from the club head. Thereby reducing lost or misplaced components during club head adjustment.

Figure 1:
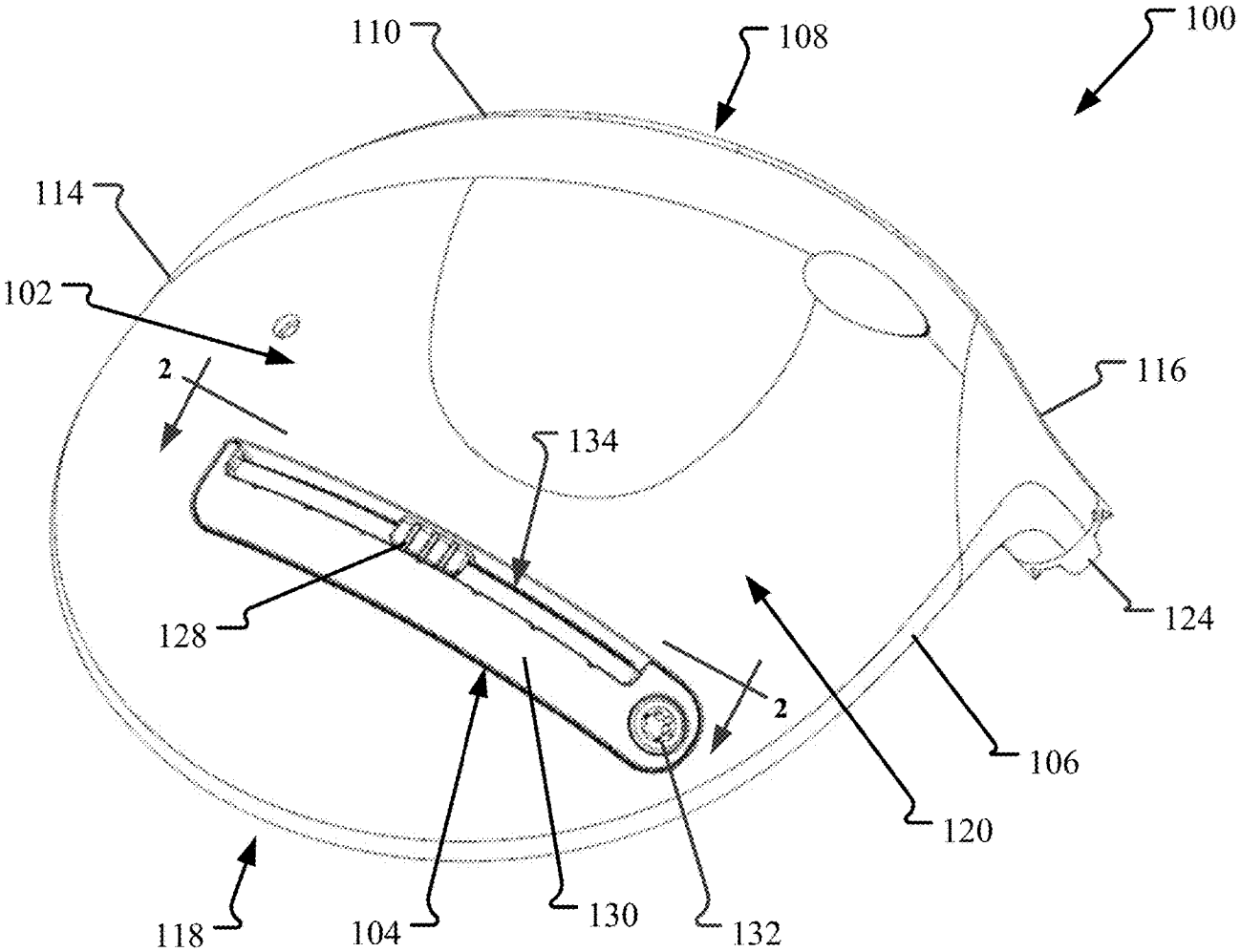
FIG. 1 is a perspective view of a sole of a golf club head with an exemplary weight assembly.

FIG. 1 is a perspective view of a sole 102 of a golf club head 100 with an exemplary weight assembly 104. The golf club head 100 is a metalwood-type golf club head having a body 106 that includes a striking face 108 positioned towards the front of the club head 100 and having a lower edge 110 and an upper edge 112 (e.g., shown in FIG. 8) each extending between a toe 114 and heel 116 of the club head 100. The sole 102 extends from the lower edge 110 on the bottom side of the club head 100 and a crown 118 extends from the upper edge 112 on the top of the club head 100. The sole 102, the striking face 108, and the crown 118 are coupled together so as to define an outer surface 120 of the body 106 with an interior cavity 122 (shown in FIG. 2) formed within. A hosel 124 is disposed at the heel 116 and is configured to couple to a shaft (not shown). In some examples, a skirt 126 (shown in FIG. 8) may also form a portion of the club head 100 and is positioned between the crown 118 and the sole 102. In such examples and for purposes of this application, the crown 118 may still be considered to be attached or coupled to the sole 102, via the skirt 126. Furthermore, the body 106 may form any type club head, such as an iron-type club head or hybrid-type club head, as required or desired.

In operation, the sole 102 generally provides the lower surface of the club head 100 when the club head 100 is placed in an address position. The club head 100 defines a center of gravity (CG) and a moment of inertia (MOI) that impact flight characteristics of a golf ball (not shown) when hit with the striking face 108. The weight assembly 104 is coupled to the club head 100 such that the CG and/or the MOI of the club head 100 can be selectively adjusted as required or desired. In the example, the weight assembly 104 includes a movable weight 128, a cover 130 configured to secure the weight 128 in place, and a fastener 132 for coupling the weight assembly 104 to one or more other portions of the club head 100. In some examples, the weight 128 may be formed from tungsten. In examples, the weight 128 may be between about 2 grams to 15 grams. In some specific examples, the weight 128 may be about 9 grams.

A recessed elongated channel 134 is formed in the outer surface 120 of the club head 100. More specifically, the channel 134 is substantially linear and defined in the sole 102 of the club head 100. In other examples, the channel 134 may be defined at any other location of the body 106 (e.g., the crown 118 or the skirt 126) as required or desired. The channel 134 is sized and shaped to receive at least a portion of the weight 128 so that the weight 128 can be slidable therein. In the example, the channel 134 extends substantially linearly in a toe 114-heel 116 direction so that the CG and the MOI of the club head 100 can be adjusted (by selectively moving the weight 128) for fade or draw bias. The channel 134 can be angularly offset from the plane of the striking face 108 as illustrated in FIG. 1. In other examples, the channel 134 may extend substantially parallel to the striking face 108. In the example, the fastener 132 is positioned proximate to the heel side of the channel 134. In other examples, the fastener 132 may be positioned at any other location relative to the channel 134 to enable the weight assembly 104 to function as described herein. For example, at approximately a midpoint of the channel 134 as described in reference to FIG. 26 or proximate the toe side of the channel 134.

In operation and through use of the fastener 132, the cover 130 is coupled to the body 106 and extends at least partially over the channel 134 so as to selectively secure the weight 128 to the club head 100. Additionally, the cover 130 covers at least a portion of the channel 134 so as to reduce dust and dirt from accumulating therein. However, the fastener 132 is separate from the weight 128 and only indirectly (e.g., via the cover 130) secures the weight 128 to the club head 100. In examples, the fastener 132 and the cover 130 are adapted to retain the weight 128 in the channel 134 only by contact with the cover 130 such that the fastener 132 never engages the weight 128. As described herein, when the fastener 132 indirectly retains the weight 128, the fastener 132 never engages the weight 128 directly and it is a separate component (e.g., the cover 130) that directly engages the weight 128 for securement to the club head 100.

The cover 130 may be loosened or completely removed, via the fastener 132, from the club head 100 to enable the weight 128 to slide within the channel 134 and selectively adjust the CG and the MOI as required or desired. Because the weight 128 is selectively moveable, the weight assembly 104 (e.g., the fastener 132, the weight 128, and the cover 130) enables the movement of the weight 128, while also securing the weight 128 to one or more portions of the club head 100 so that undesirable movement (e.g., during a club swing) is reduced or prevented. By separating the fastener 132 from the weight 128, the size, shape, and/or density of the weight 128 may be configured so that the CG and the MOI of the club head 100 may be more finely tuned, thereby increases the performance of the golf club head 100. The weight assembly 104 is described further below.

Figure 2:
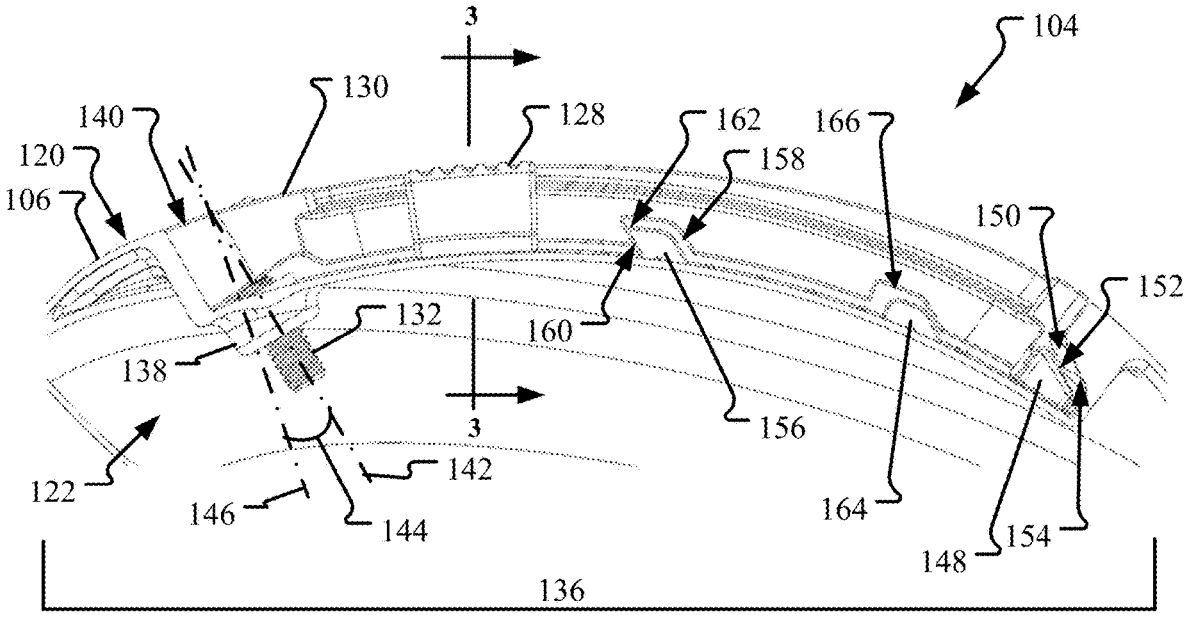
FIG. 2 is a cross-sectional view of the golf club head taken along line 2-2 in FIG. 1 where the weight assembly is in a locked configuration.
Figure 3:
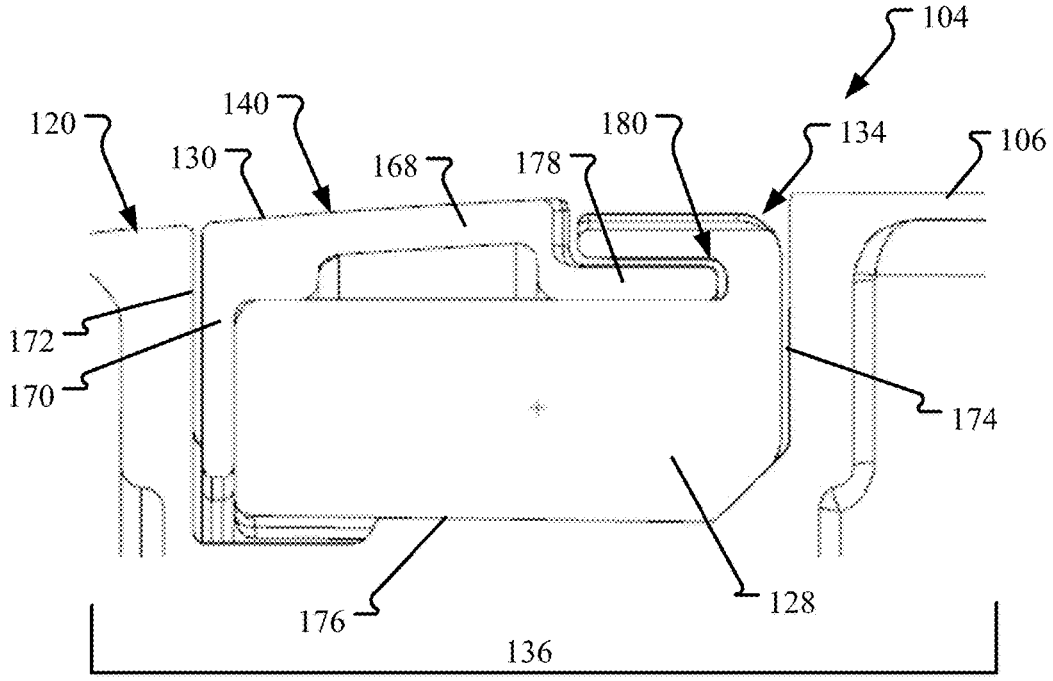
FIG. 3 is a cross-sectional view of the weight assembly taken along line 3-3 in FIG. 2.

FIG. 2 is a cross-sectional view of the golf club head 100 taken along line 2-2 in FIG. 1 and showing the weight assembly 104 in a locked configuration 136. FIG. 3 is a cross-sectional view of the weight assembly 104 taken along line 3-3 in FIG. 2. Referring concurrently to FIGS. 2 and 3, when the weight assembly 104 is in the locked configuration 136, the cover 130 is disposed within the channel 134 and the weight 128 is secured within the channel 134 such that movement is restricted. In the example, to lock the cover 130 to the body 106, the fastener 132 may be a threaded bolt that threadingly engages with a nut 138 positioned within the heel end of the channel 134. In some examples, the nut 138 may be integrally formed within the body 106.

When the cover 130 is in the locked configuration 136, an exterior surface 140 of the cover 130 is substantially aligned (e.g., flush) with the outer surface 120 of the body 106. Additionally, the fastener 132 defines a fastener axis 142. In the example, the fastener axis 142 is disposed at an angle 144 relative to a plane 146 that is normal to the exterior surface 140 of the cover 130 proximate the fastener 132. The angle 144 defines the orientation that the cover 130 may move relative to the body 106. The angle 144 may be between about 0° (e.g., aligned with the plane 146) and about 88°. In examples, the angle 144 may be between about 20° and 50°. In one example, the angle 144 may be about 45°.

In the example, only a single fastener 132 is used to couple the cover 130 to the body 106 and the fastener 132 is positioned at the heel end of the weight assembly 104. As such, to connect the toe end of the cover 130 to the body 106, the cover 130 may include one or more projections 148 that extend from the toe end. The projection 148 is sized and shaped to be received within one or more corresponding chambers 150 defined at the toe end of the channel 134. When the weight assembly 104 is in the locked configuration 136, the projection 148 is received at least partially within the chamber 150 and engaged therewith. By engaging the cover 130 to the body 106 at a position opposite from the fastener 132, when the weight 128 is positioned away from the fastener 132, the cover 130 still enables securement of the weight 128 within the channel 134 and reduces or prevents movement of the weight 128 in the locked configuration 136. In the example, the projection 148 extends in the toe-heel direction of the cover 130 and includes at least one oblique surface 152 that frictionally engages with a corresponding at least one oblique surface 154 of the chamber 150. In some examples, the oblique surfaces 152, 154 may be substantially parallel to the fastener axis 142. In other examples, the oblique surfaces 152, 154 may be oriented at a different angle than the fastener axis 142 (e.g., steeper or shallower angles). Additionally or alternatively, the projection 148 and chamber 150 may extend substantially orthogonal to the toe-heel direction (e.g., in and out of the page of FIG. 2).

The cover 130 may also be engaged with the body 106 at one or more intermediate positions between the fastener 132 and the opposite end. A seat 156 may protrude into the channel 134 at a location between the toe end and the heel end, for example, proximate a midpoint location of the channel 134. The seat 156 is sized and shaped to be received within a corresponding notch 158 defined in the cover 130. When the weight assembly 104 is in the locked configuration 136, the seat 156 is received at least partially within the notch 158 and engaged therewith. This engagement of the cover 130 to the body 106 at a position away from the fastener 132, also secures the weight 128 within the channel 134 and reduces or prevents movement of the weight 128 in the locked configuration 136. In the example, the seat 156 extends in the toe-heel direction of the channel 134 and includes at least one oblique surface 160 that frictionally engages with a corresponding at least one oblique surface 162 of the notch 158. In some examples, the oblique surfaces 160, 162 may be substantially parallel to the fastener axis 142. In other examples, the oblique surfaces 160, 162 may extend at angle relative to the bottom of the channel 134 between about 3° and 88°. In one example, the oblique surfaces 160, 162 may extend at an angle relative to the bottom of the channel 134 of about 30°.

A cam 164 may also protrude into the channel 134 at a location between the toe end and the heel end, for example, between the seat 156 and the chamber 150. The cam 164 is sized and shaped to receive within a corresponding cutout 166 defined in the cover 130. When the weight assembly 104 is in the locked configuration 136, the cam 164 is received at least partially within the cutout 166. The cam 164 and the cutout 166 are described further below in reference to FIG. 4.

In the example, the cover 130 is substantially L-shaped with a long leg 168 and a short leg 170. In the locked configuration 136, the long leg 168 forms the exterior surface 140 and the short leg 170 extends within the channel 134. The channel 134 is formed from two opposing sidewalls 172, 174 and a bottom track 176 offset from the outer surface 120 of the body 106. The long leg 168 of the cover 130 opposes the track 176 of the channel 134 and the short leg 170 of the cover 130 is adjacent to one of the sidewalls 172. The seat 156 and the cam 164 may protrude from the sidewall 172 of the channel 134 and the corresponding notch 158 and cutout 166 may be defined in the short leg 170 of the cover 130. When the weight 128 is secured within the channel 134 and in the locked configuration 136, the weight 128 is compressed between cover 130 and one or more walls (e.g., the sidewall 174 and/or the track 176) of the channel 134. As such, the weight 128 is frictionally secured to one or more portions of the club head 100 by the weight assembly 104.

Additionally, the weight 128 may be slidably coupled to the cover 130. The long leg 168 of the cover 130 may include a flange 178 extending therefrom. The flange 178 is sized and shaped to be received at least partially within a corresponding groove 180 defined in the weight 128. In the locked configuration 136, a portion of the weight 128 is not covered by the cover 130 and exposed within the channel 134 such that the portion forms part of the outer surface 120 of the body 106. This enables for the location of the weight 128 within the channel 134 to be easily determined by visual inspection.

Figure 4:
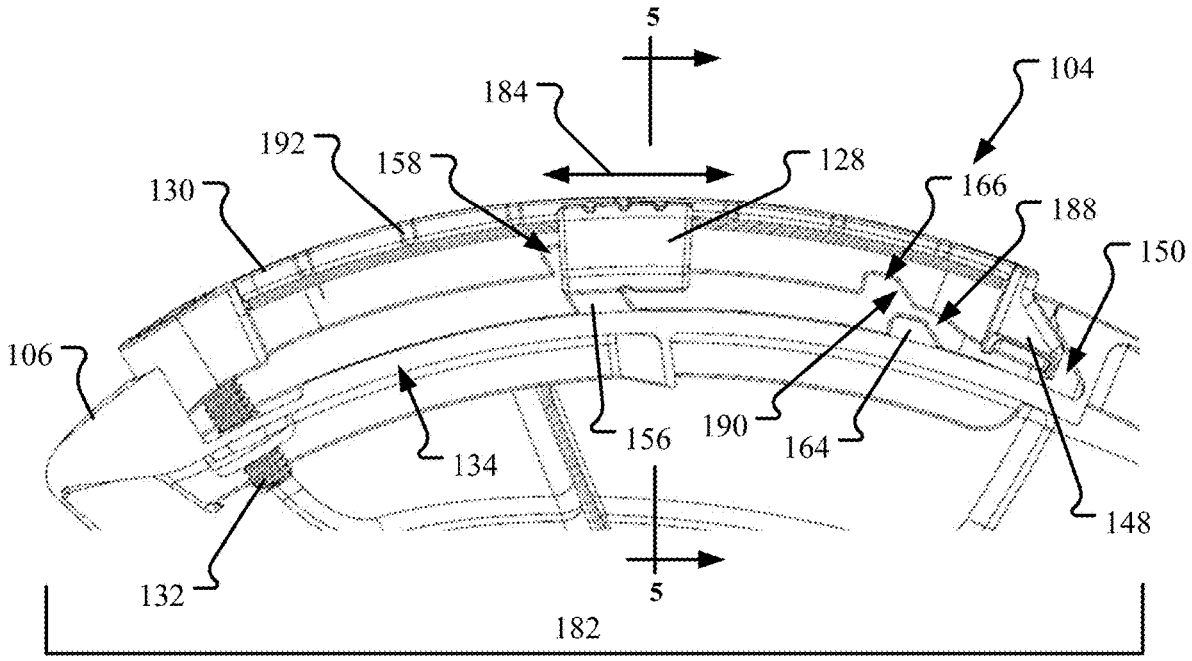
FIG. 4 is a cross-sectional view of the golf club head taken along line 2-2 in FIG. 1 where the weight assembly is in an unlocked configuration.
Figure 5:
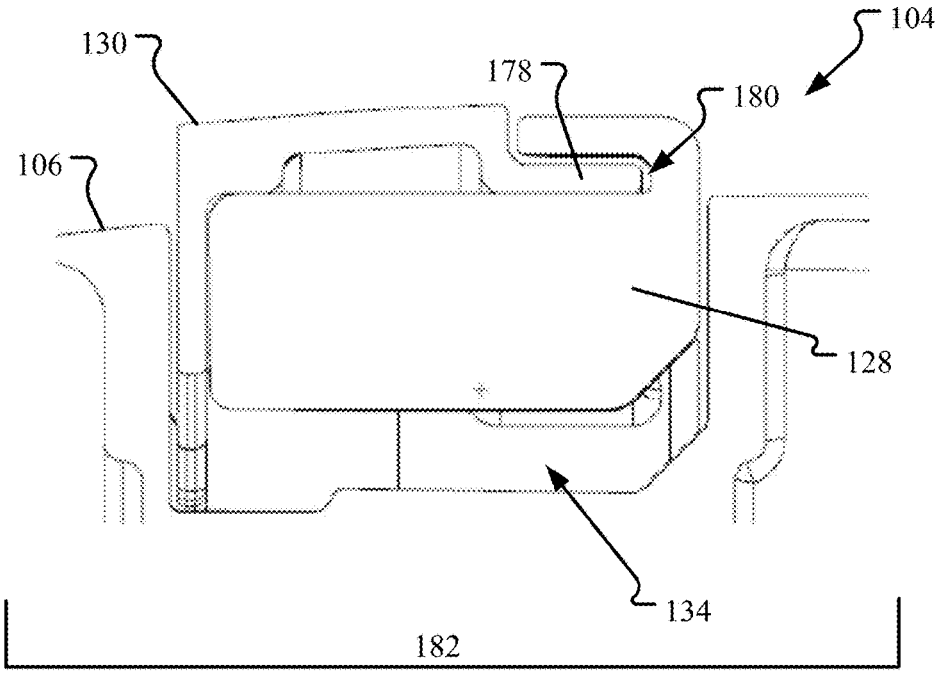
FIG. 5 is a cross-sectional view of the weight assembly taken along line 5-5 in FIG. 4.

FIG. 4 is a cross-sectional view of the club head 100 taken along line 2-2 in FIG. 1 and showing the weight assembly 104 in an unlocked configuration 182. FIG. 5 is a cross-sectional view of the weight assembly 104 taken along line 5-5 in FIG. 4. Referring concurrently to FIGS. 4 and 5, when the weight assembly 104 is in the unlocked configuration 182, at least a portion of the cover 130 is lifted and raised out of the channel 134 such that the weight 128 is selectively slidable (e.g., along a toe-heel direction 184) within the channel 134. In the example, the fastener 132 may be coupled to the cover 130 (e.g., with a lock washer 186 (shown in FIG. 16)), so that the cover 130 moves along the fastener axis 142 (shown in FIG. 2) upon rotation of the fastener 132. The cover 130 and the fastener 132 may be completely removed from the body 106 as required or desired so as to completely remove the weight 128 from the channel 134. However, in examples, moving the weight assembly 104 between the locked configuration 136 (shown in FIGS. 2 and 3) and the unlocked configuration 182 does not require that the weight assembly 104 be uncoupled from the body 106. As such, in the unlocked configuration 182, the cover 130 may remain coupled to the body 106 so that it is less likely that the components become lost or misplaced. In some examples, the fastener 142 and/or the nut 138 may include a hard stop (not shown) that prevents the fastener 142 from being completely de-threaded from the club head 100 as required or desired.

Since only a single fastener 132 is used to couple the cover 130 to the body 106 and the fastener 132 is positioned at the heel end of the weight assembly 104, the cam 164 may be used to assist the toe end of the cover 130 with lifting from the channel 134 in the unlocked configuration 182. This enables the weight 128 to more easily slide to positions away from the fastener 132. In the example, the cam 164 extends in the toe-heel direction of the channel 134 and includes at least one camming surface 188 that slidingly engages with a corresponding camming surface 190 of the cutout 166. As the cover 130 moves from the locked configuration 136, where the cam 164 is received within the cutout 166, toward the unlocked configuration 182, the camming surfaces 188, 190 slide against one another to lift the toe end of the cover 130. In some examples, when the weight assembly 104 is in the unlocked configuration 182, a portion of the cover 130 may be supported on the cam 164. The camming surfaces 188, 190 may be substantially parallel to the fastener axis 142.

Additionally, in the unlocked configuration 182, the notch 158 may lift away from the seat 156 to disengage the oblique surfaces 160, 162 (shown in FIG. 2). In the unlocked configuration 182, the notch 158 may lift partially or completely for the seat 156. The projection 148 may also lift away from the chamber 150. However, the projection 148 may remain at least partially engaged with the chamber 150 so that the weight 128 cannot slide out of the toe end of the cover 130 and remain within the channel 134 in the unlocked configuration 182. Furthermore, because the weight 128 is engaged with the cover 130 (e.g., the flange 178 and the groove 180), the weight 128 moves with the cover 130 between the locked configuration 136 and the unlocked configuration 182. This enables the weight 128 to be more easily slidable in the unlocked configuration 182.

In some examples, one or more of the weight 128, the cover 130, and the channel 134 may include complementary features (e.g., corresponding detents 192 on the cover 130 and recesses (not shown) on the weight 128) that index the location of the weight 128 to the channel 134 and/or the cover 130. These complementary indexing features may provide tactile and/or audible feedback when the weight 128 is moved. Additionally, the complementary indexing features may also provide increased resistance to the relative movement between the weight 128 and the channel 134 and/or cover 130 when the weight assembly 104 is in the locked configuration 136.

Figure 6:
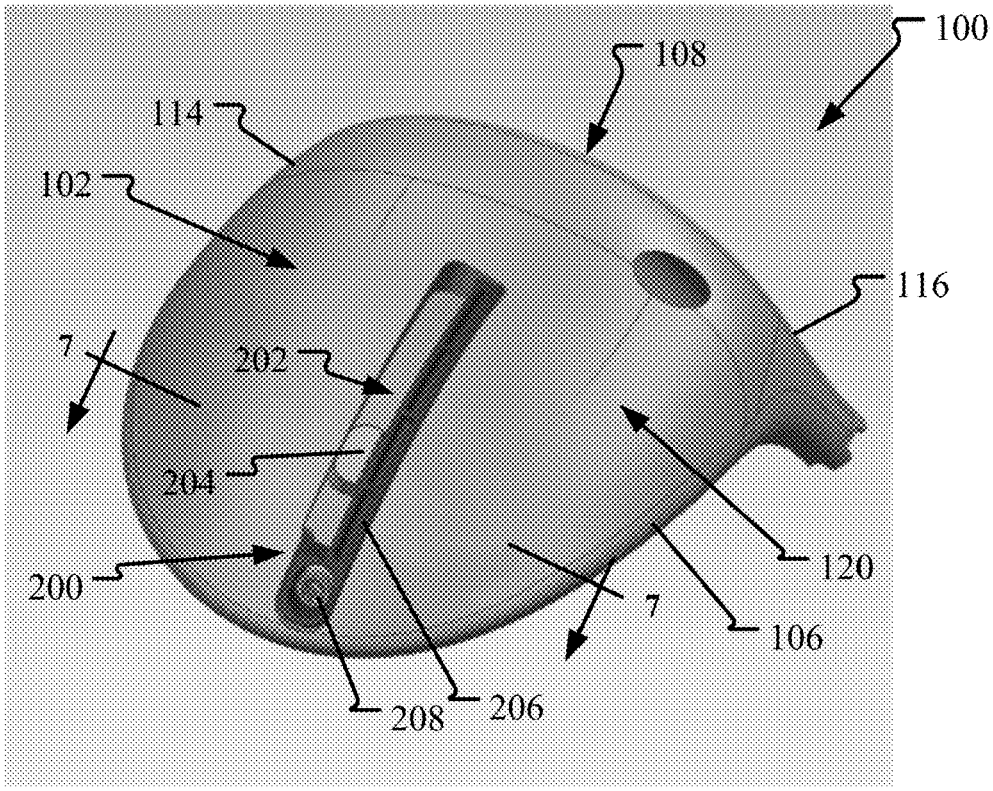
FIG. 6 is a perspective view of the sole of the golf club head with another weight assembly.
Figure 7:
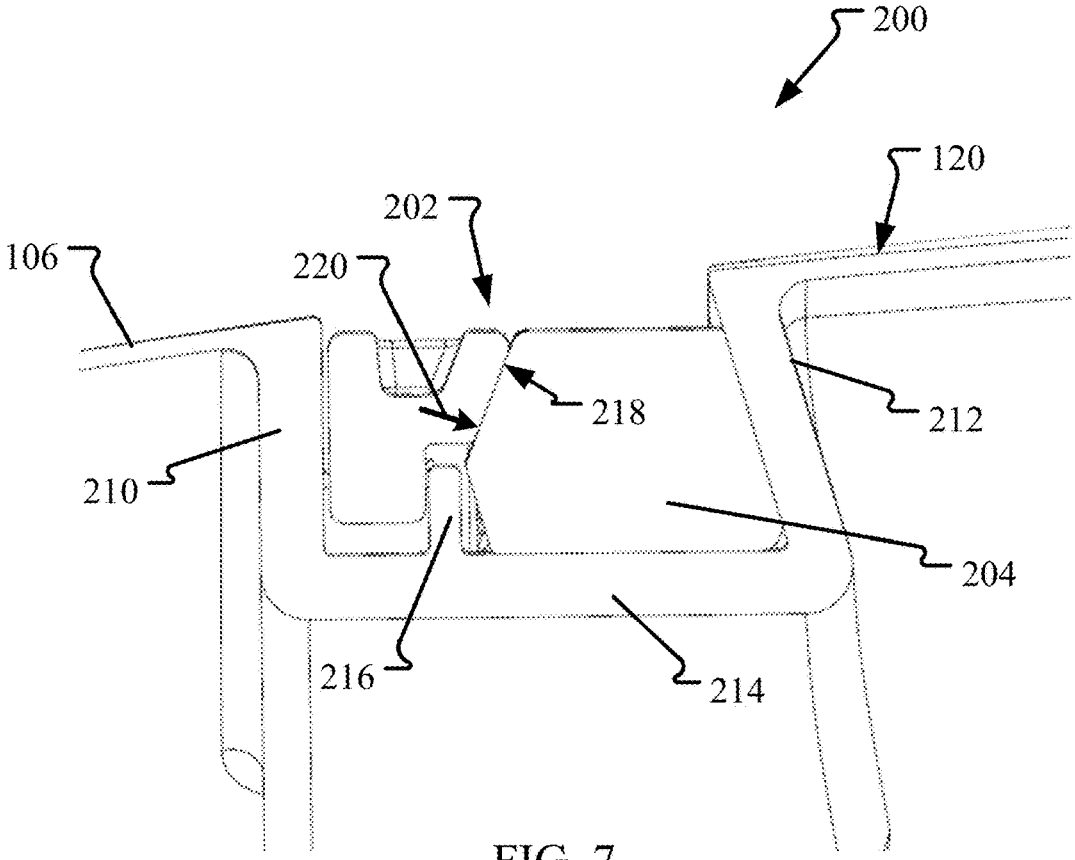
FIG. 7 is a cross-sectional view of the weight assembly taken along line 7-7 in FIG. 6.

FIG. 6 is a perspective view of the sole 102 of the golf club head 100 with another weight assembly 200. FIG. 7 is a cross-sectional view of the weight assembly 200 taken along line 7-7 in FIG. 6. Certain components are described above, and thus, are not necessarily described further. Referring concurrently to FIGS. 6 and 7, the weight assembly 200 includes a recessed channel 202 defined within the sole 102 of the body 106 of the club head 100, however, the channel 202 extends substantially linearly in a front-rear direction so that the CG and the MOI of the club head 100 can be adjusted for launch angle bias. The channel 202 can be substantially orthogonal to the striking face 108 as illustrated in FIG. 6. In other examples, the channel 202 may extend at either an acute or obtuse angle relative to the striking face 108. The weight assembly 200 also includes a slidable weight 204, a cover 206, and a fastener 208. In this example, the fastener 208 is positioned proximate to the rear of channel 202 and opposite of the striking face 108. In other examples, the fastener 208 may be positioned at any other location relative to the channel 202 to enable the weight assembly 200 to function as described herein. For example, at approximately a midpoint of the channel 202 or proximate the striking face 108 side of the channel 202.

In this example, the channel 202 is formed by two opposing sidewalls, a cover sidewall 210 and an undercut sidewall 212, and a bottom track 214 offset from the outer surface 120 of the body 106. A partial wall 216 also extends from the bottom track 214. Here, the cover 206 is located adjacent to the cover sidewall 210 and includes an angled surface 218. As such, when the weight assembly 200 is in a locked configuration (e.g., FIG. 7), the cover 206 generates a compressive force 220 along the angled surface 218 that acts in both a downward direction and a transverse direction to secure the weight 204 between the cover 206 and the undercut sidewall 212. Accordingly, the weight 204 is frictionally secured to one or more portions of the club head 100 by the weight assembly 200 and at least partially underneath the angled surface 218 and the undercut sidewall 212. The weight 204 is at least partially trapezoidal in cross-sectional shape so that the undercuts of the sidewall 212 and the cover 206 assist in retaining the weight 204 within the channel 202. Additionally, the cover 206 engages with the partial wall 216 so that the portion of the cover 206 away from the fastener 208 is restricted from moving within the channel 202 (e.g., bending or flexing) towards the undercut sidewall 212. Furthermore, the partial wall 216 is substantially parallel to the fastener axis (not shown) of the fastener 208 so that the cover 206 is guided between the locked and unlocked configuration. In some example, the weight assembly 200 may include the seat/notch interface as described above to further engage the cover 206 within the channel 202 and increase the securement of the weight 204 to one or more portions of the club head 100.

Figure 8:
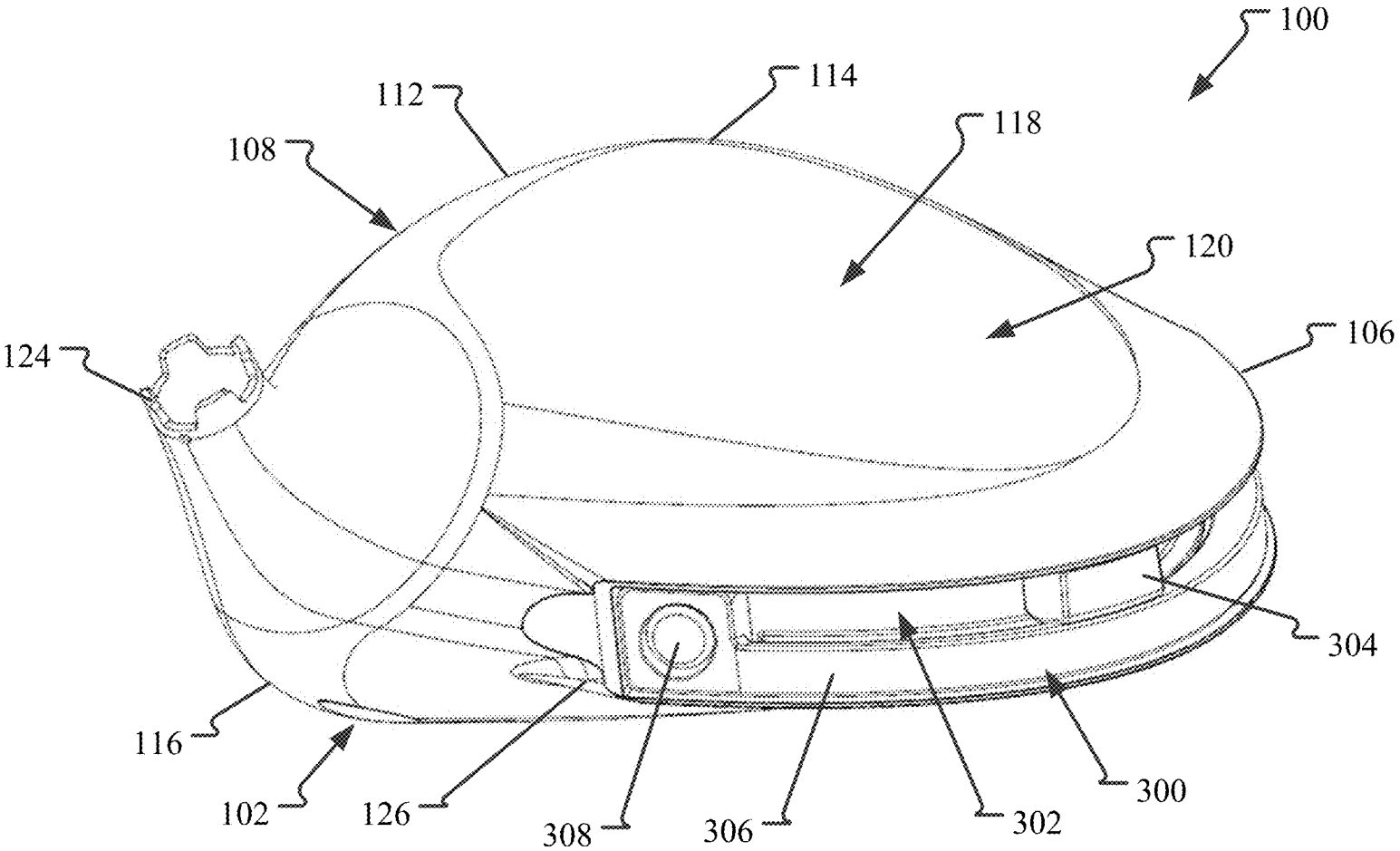
FIG. 8 is a perspective view of the golf club head with another weight assembly.

FIG. 8 is a perspective view of the golf club head 100 with another weight assembly 300. Certain components are described above, and thus, are not necessarily described further. In this example, the club head 100 includes the skirt 126 positioned between the crown 118 and the sole 102, opposite of the striking face 108. The weight assembly 300 includes a recessed channel 302 defined within the skirt 126 of the body 106 of the club head 100 and extends along the rear perimeter of the club head 100 such that the channel 302 has a curved shape. The weight assembly 300 also includes a slidable weight 304, a cover 306, and a fastener 308. In this example, the fastener 308 is coupled to the heel 116 side of the body 106. In other examples, the fastener 308 may be coupled to the toe 114 side of the body 106 as required or desired. The weight assembly 300 may include one or more of the weight assembly features described herein to enable the CG and the MOI of the club head 100 to be adjustable for fade-draw bias, while securing the weight 304 in a locked configuration (as shown in FIG. 8).

Figure 9:
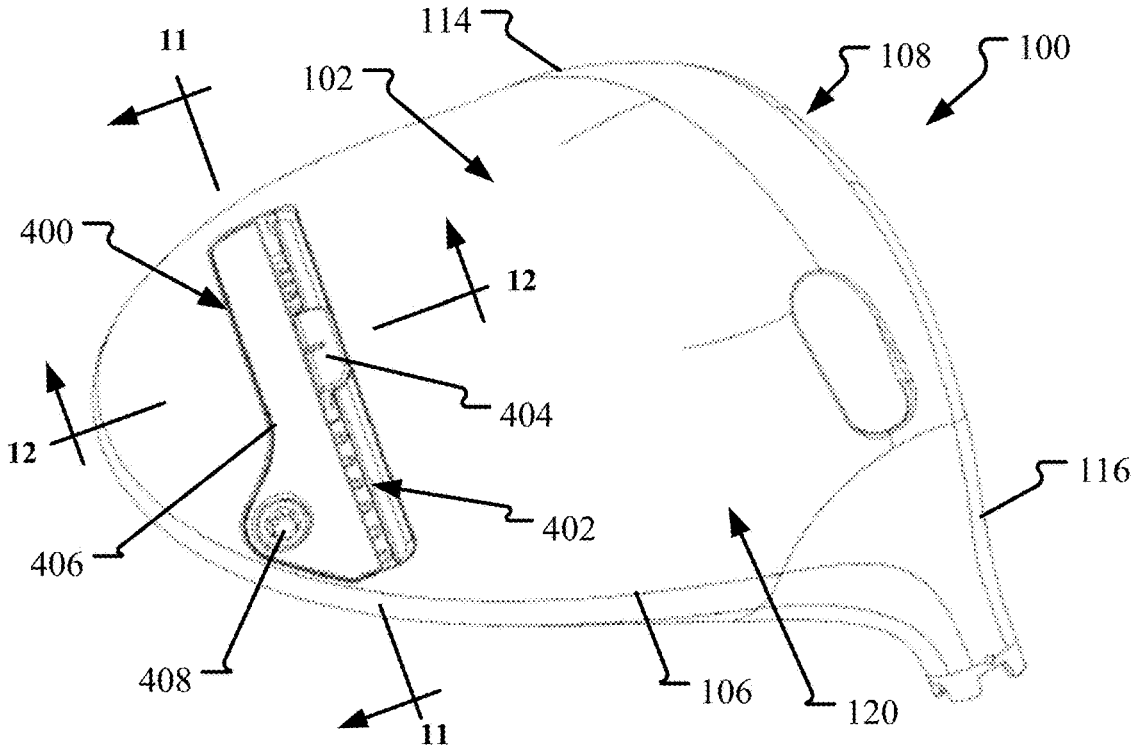
FIG. 9 is a perspective view of the sole of the golf club head with another weight assembly.
Figure 10:
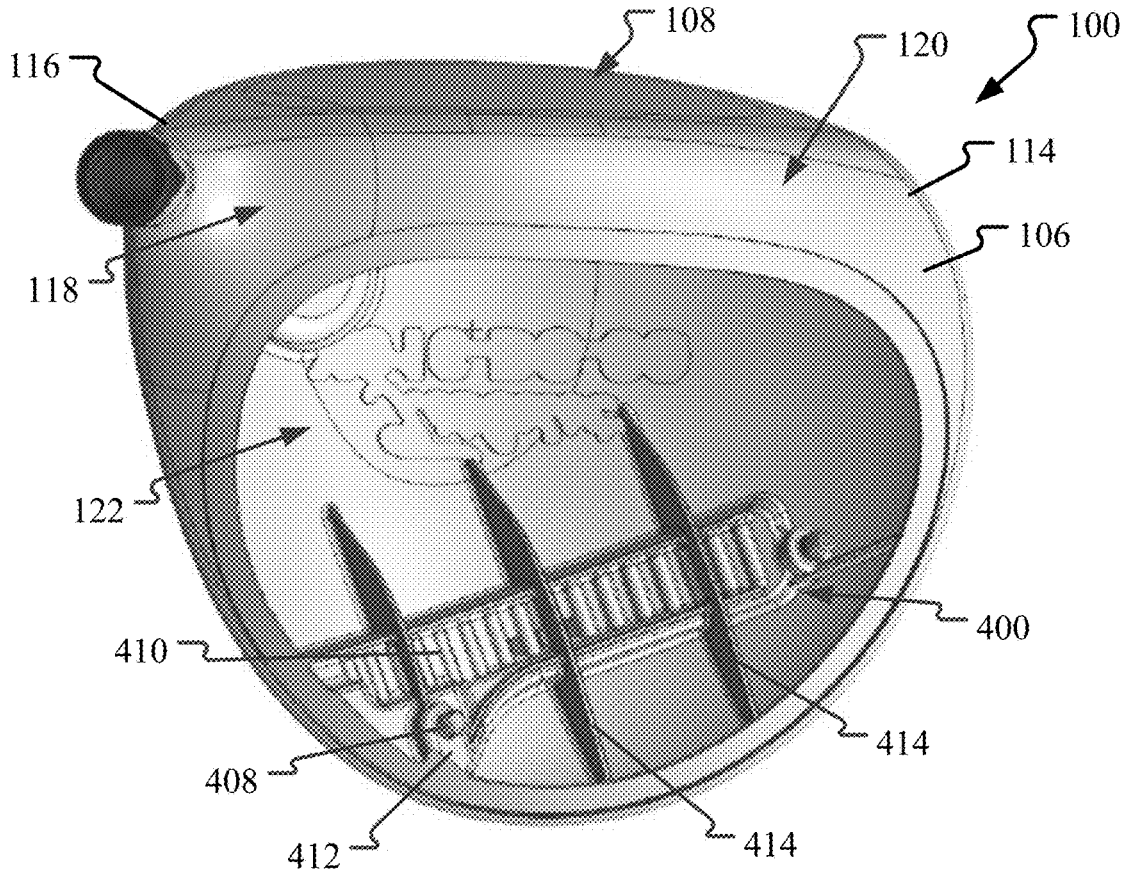
FIG. 10 is a top view of the golf club head shown in FIG. 9 with a portion of a crown removed.

FIG. 9 is a perspective view of the sole 102 of the golf club head 100 with another weight assembly 400. FIG. 10 is a top view of the golf club head 100 shown in FIG. 9 with a portion of the crown 118 removed. Certain components are described above, and thus, are not necessarily described further. Referring concurrently to FIGS. 9 and 10, the weight assembly 400 includes a recessed channel 402 defined within the sole 102 of the body 106 of the club head 100 that extends substantially linearly in the toe 114-heel 116 direction. The weight assembly 400 also includes a slidable weight 404, a cover 406, and a fastener 408. The channel 402 includes a bottom track 410 that the weight 404 is slidable on. In this example, the fastener 408, and also a nut 412 that the fastener 408 couples to, are offset from the track 410 and positioned towards the rear of the body 106. By offsetting the fastener 408 from the track 410, the length of the track 410 can be extended in the toe-heel direction so that the weight 404 can be positioned at a greater number of locations on the sole 102. In other examples, the fastener 408 may be offset from the track 410 and positioned towards the front and the striking face 108 of the body 106 as required or desired.

In this example, one or more support ribs 414 may extend from the channel 402 and within the interior cavity 122 of the body 106. The support ribs 414 are substantially orthogonal to the length of the channel 402. The support ribs 414 provide structural strength to the channel 402 so that the channel 402 is resistant to deformation when the cover 406 compresses the weight 404 therein. In some examples, the support ribs 414 may extend the entire distance between the sole 102 and the crown 118 within the interior cavity 122.

Figure 11:
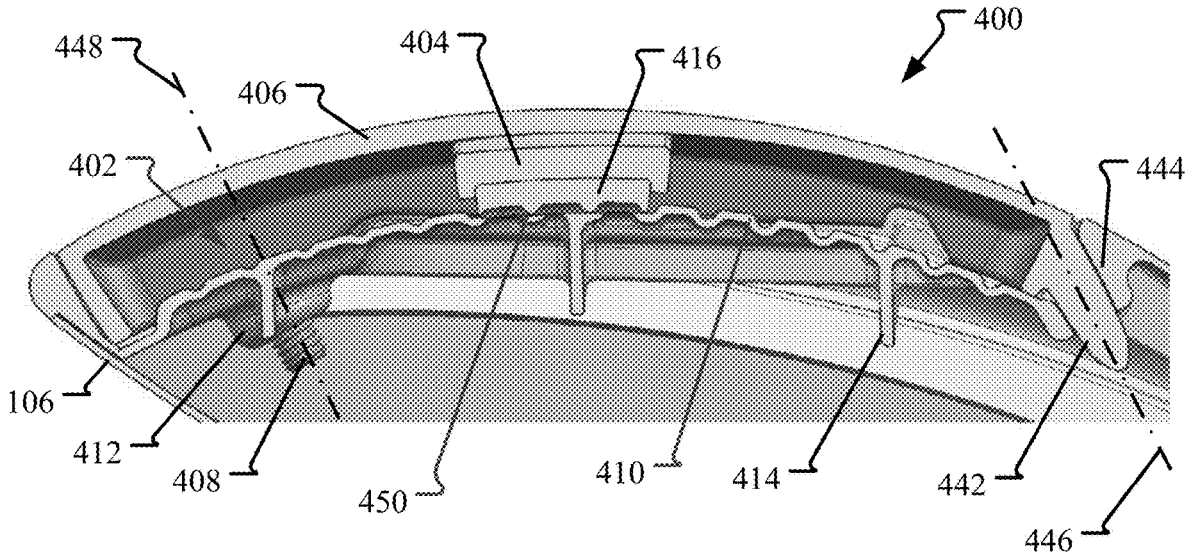
FIG. 11 is a cross-sectional view of the weight assembly taken along line 11-11 in FIG. 9.
Figure 12:
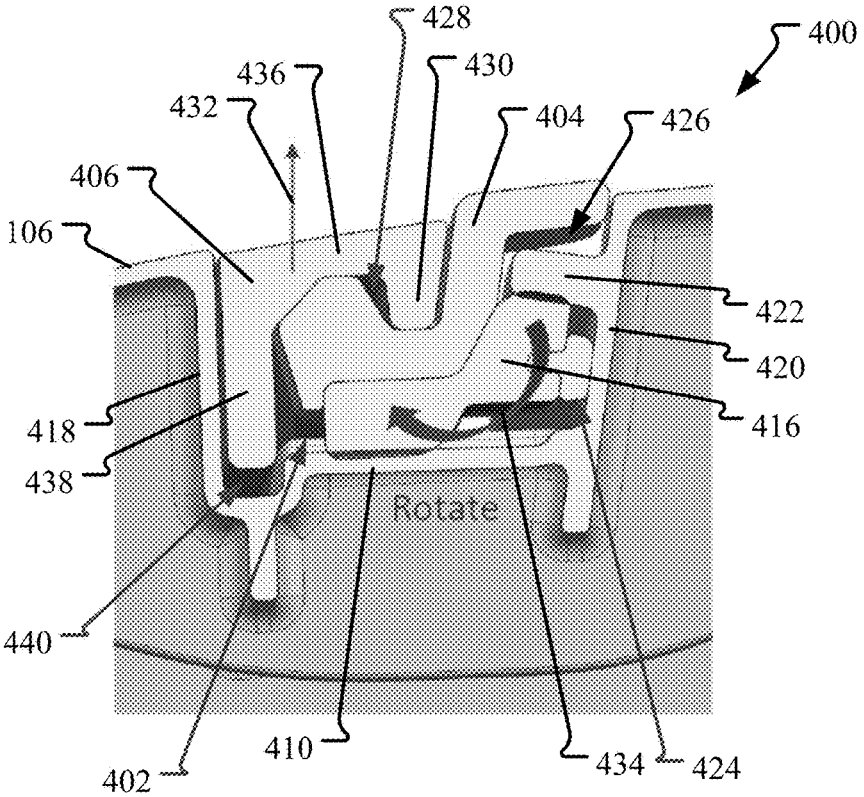
FIG. 12 is a cross-sectional view of the weight assembly taken along line 12-12 in FIG. 9.

FIG. 11 is a cross-sectional view of the weight assembly 400 taken along line 11-11 in FIG. 9. FIG. 12 is a cross-sectional view of the weight assembly 400 taken along line 12-12 in FIG. 9. Certain components are described above, and thus, are not necessarily described further. Referring concurrently to FIGS. 11 and 12, the weight assembly 400 is illustrated in a locked configuration so that the weight 404 is secured within the channel 402. In this example, the weight 404 includes an elastomeric material 416 (e.g., a rubber-based material) that engages with the channel 402 and/or the cover 406 and further increase securement of the weight 404 in the locked configuration. Additionally, the elastomeric material 416 decreases rattling of the weight 404 within the channel 402 during the swing of the club head.

In this example, the channel 402 is formed from two opposing sidewalls 418, 420 and the track 410. One sidewall 420 may include an elongate fin 422 extending into the channel 402. The weight 404 is sized and shaped to be received at least partially within the channel 402 and includes a bottom surface 424 that is positioned adjacent to the track 410 and a slot 426 that engages with the fin 422. Additionally, opposite of the slot 426, the weight 404 includes a groove 428 that engages with a flange 430 of the cover 406. The elastomeric material 416 may be coupled to the weight 404 so that the material 416 extends from the bottom surface 424 and also into the slot 426. In one example, the elastomeric material 416 may be a unitary piece that extends through one or more holes within the weight 404. In other examples, the elastomeric material 416 may be adhered to one or more external surfaces of the weight 404. In still other examples, at least a portion of the elastomeric material 416 may form the weight 404 itself.

In operation, when the cover 406 is in the locked configuration, the flange 430 engages with the groove 428 of the weight 404 and compresses the weight 404 into the channel 402. As such, the elastomeric material 416 may engage with the track 410 and the fin 422 of the channel 402. By engaging the elastomeric material 416 in more than one location, securement of the weight 404 within the channel 402 increases. This reduces undesirable movement and rattling of the weight 404 within the channel 402. In some examples, the elastomeric material 416 may deform when compressed within the channel 402. Since the cover 406 engages with only a portion of the weight 404, when the cover 406 is lifted 432 for the unlocked configuration (not shown), the weight 404 can rotate 434 within the channel 402 so that the elastomeric material 416 may disengage from the track 410 and the fin 422. This rotational movement 434 enables the weight 404 to be more easily slidable within the channel 402 while in the unlocked configuration because the elastomeric material 416 is at least partially positioned away from the channel surfaces. In some examples, the elastomeric material 416 extending from the bottom surface 424 may be only proximate the groove 428 so as to increase rotational movement 434 of the weight 404.

The cover 406 is substantially L-shaped in cross-section (see FIG. 12) and receives at least a portion of the weight 404 therein. The cover includes a first leg 436 that has the flange 430 and a second leg 438 that is adjacent to the sidewall 418 of the channel 402. The flange 430 may be substantially parallel to the second leg 438 so as to increase the structural rigidity of the cover 406 in the lengthwise direction. The second leg 438 may extend at least partially within a depression 440 of the track 410 so as to decrease bending of the cover 406 while in the locked configuration. Additionally, in the example, a projection 442 of the cover 406 may be substantially cylindrical in shape. The projection 442 is received within a corresponding cylindrical chamber 444. This projection 442 and chamber 444 structure increases the engagement of the cover 406 with the body 106 in the locked configuration (as illustrated in FIG. 11). In some examples, a projection axis 446 of the projection 442 may be substantially parallel to a fastener axis 448. This orientation guides the movement of the cover 406 between the locked configuration and the unlocked configuration. In some examples, the projection 442 may include a tapered nose. In this example, the weight 404 and the channel 402 may include complementary features 450 that index the location of the weight 404 to the channel 402.

Figure 13:
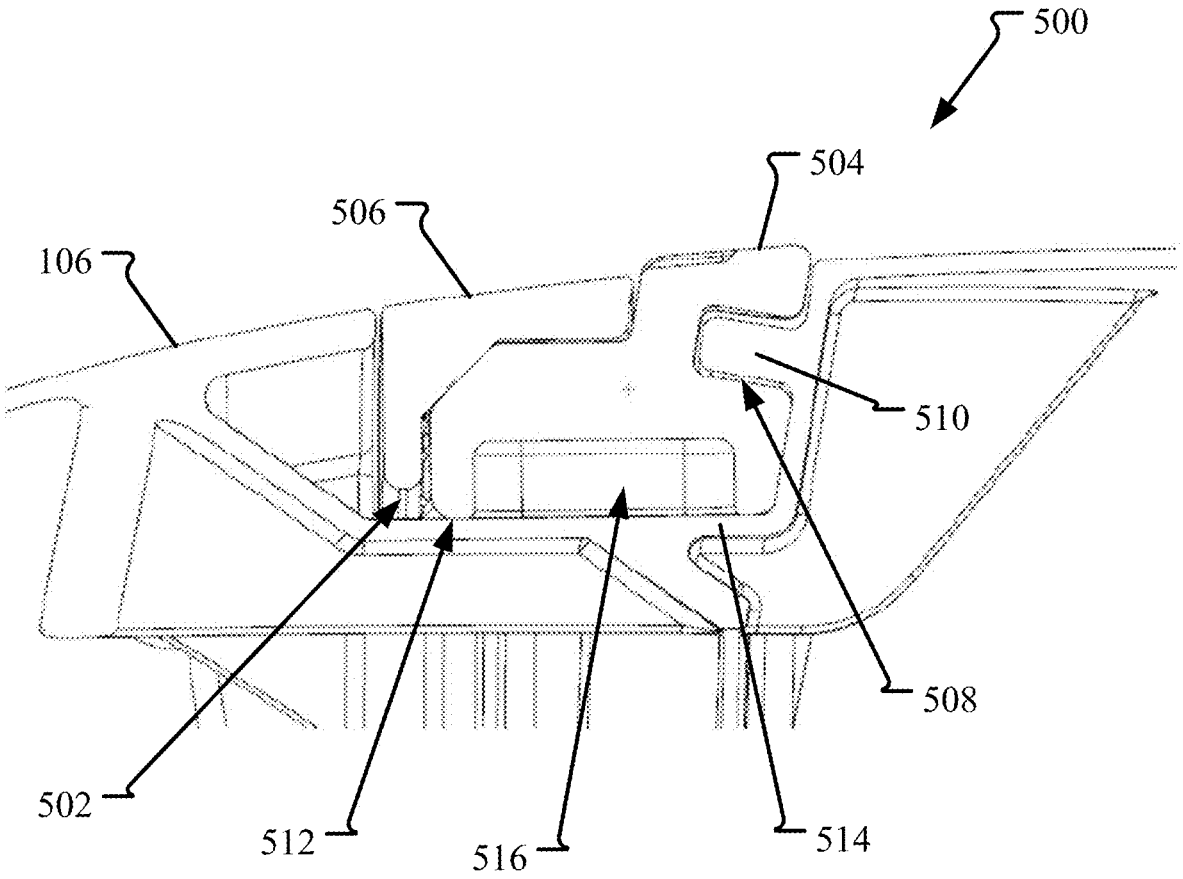
FIG. 13 is a cross-sectional view of another weight assembly.

FIG. 13 is a cross-sectional view of another weight assembly 500. Certain components are described above, and thus, are not necessarily described further. Similar to the example described in FIGS. 9-12, in this example, the weight assembly 500 includes a recessed channel 502 defined within the body 106 of the club head. The weight assembly 500 also includes a slidable weight 504 and a cover 506. The cover 506 is shown in a locked configuration and a slot 508 of the weight 504 is engaged with a fin 510 of the channel 502. However, in this example, a bottom surface 512 of the weight 504 is positioned directly against a track 514 of the channel 502. Additionally, in this example, the bottom surface 512 of the weight 504 includes a hollow 516. The hollow 516 reduces fictional sliding forces on the weight 504, when the weight assembly 500 is in the unlocked configuration (not shown). The hollow 516 also enables for the size and shape of the weight 504 to be formed while maintaining the required or desired mass and/or density of the weight 504. In some examples, an elastomeric material (not shown) may be disposed at least partially within the hollow 516.

Figure 14:
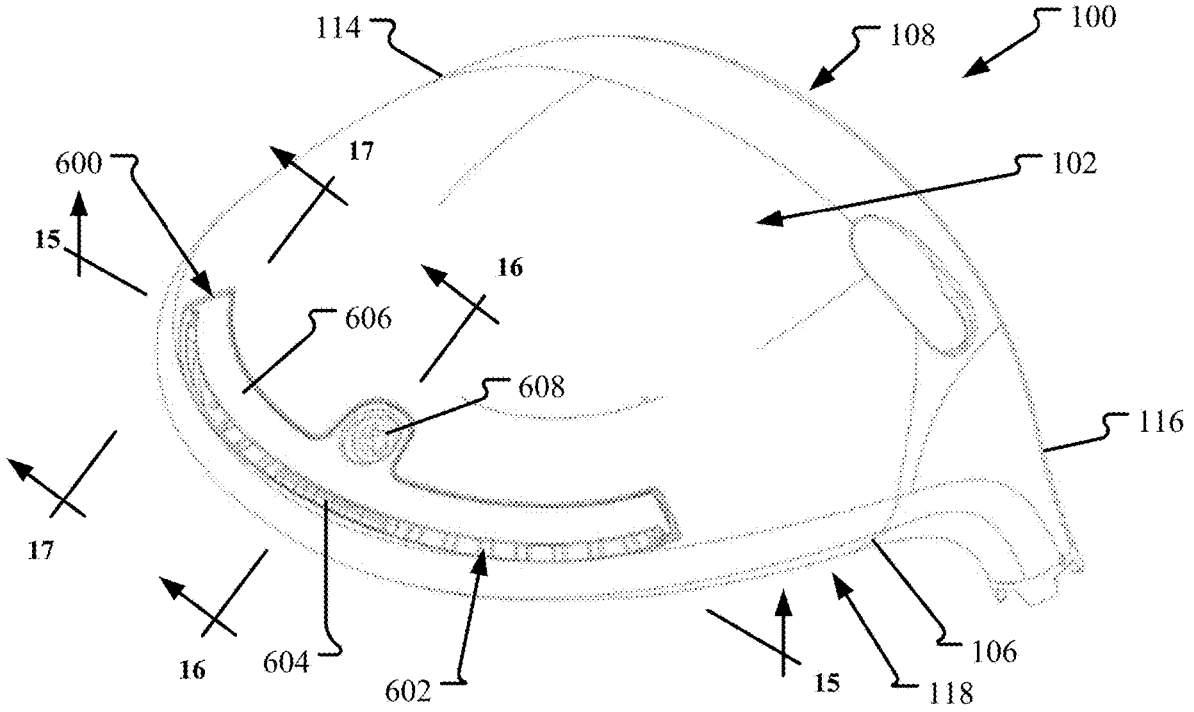
FIG. 14 is a perspective view of the sole of the golf club head with another weight assembly.

FIG. 14 is a perspective view of the sole 102 of the golf club head 100 with another weight assembly 600. Certain components are described above, and thus, are not necessarily described further. The weight assembly 600 includes a recessed channel 602 defined within the sole 102 of the body 106 of the club head 100. The channel 602 has a substantially curved shape in the toe 114-heel 116 direction so that the GC and the MOI of the club head 100 can be adjustable for fade-drawn bias. In some examples, the curve of the channel 602 matches the rear perimeter of the body 106, where the sole 102 and the crown 118 are coupled together. The weight assembly 600 also includes a slidable weight 604, a cover 606, and a fastener 608.

In this example, the fastener 608 is positioned in the concave area of the curved channel 602 and towards the striking face 108 of the body 106. This position enables the weight 604 to be positioned adjacent to the rear perimeter of the body 106 and increase the adjustability of the CG and MOI of the club head 100, when compared to having the fastener 608 positioned in the convex area of the curved channel 602 and the weight 604 being closer to the striking face 108. Additionally, the weight 604 may slide completely from the toe 114 side to the heel 116 side and be located at any position of the channel 602 even adjacent to the fastener 608. In other examples, the fastener 608 may be positioned in the convex area of the curved channel 602 as required or desired. The fastener 608 is also positioned at approximately the midpoint of the channel 602. In other examples, the fastener 608 may be offset from the midpoint of the channel 602, or two or more fastener 608 may be used to couple the cover 606 to the body 106 (e.g., at each end of the channel 602).

Figure 15:
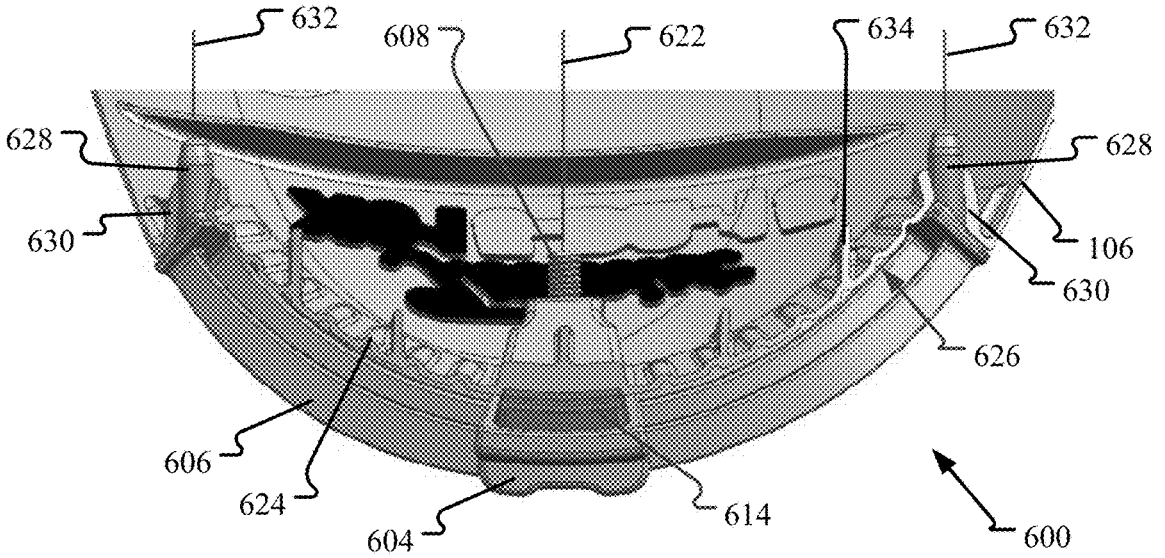
FIG. 15 is a cross-sectional view of the golf club head taken along line 15-15 in FIG. 14 and showing the weight assembly.
Figure 16:
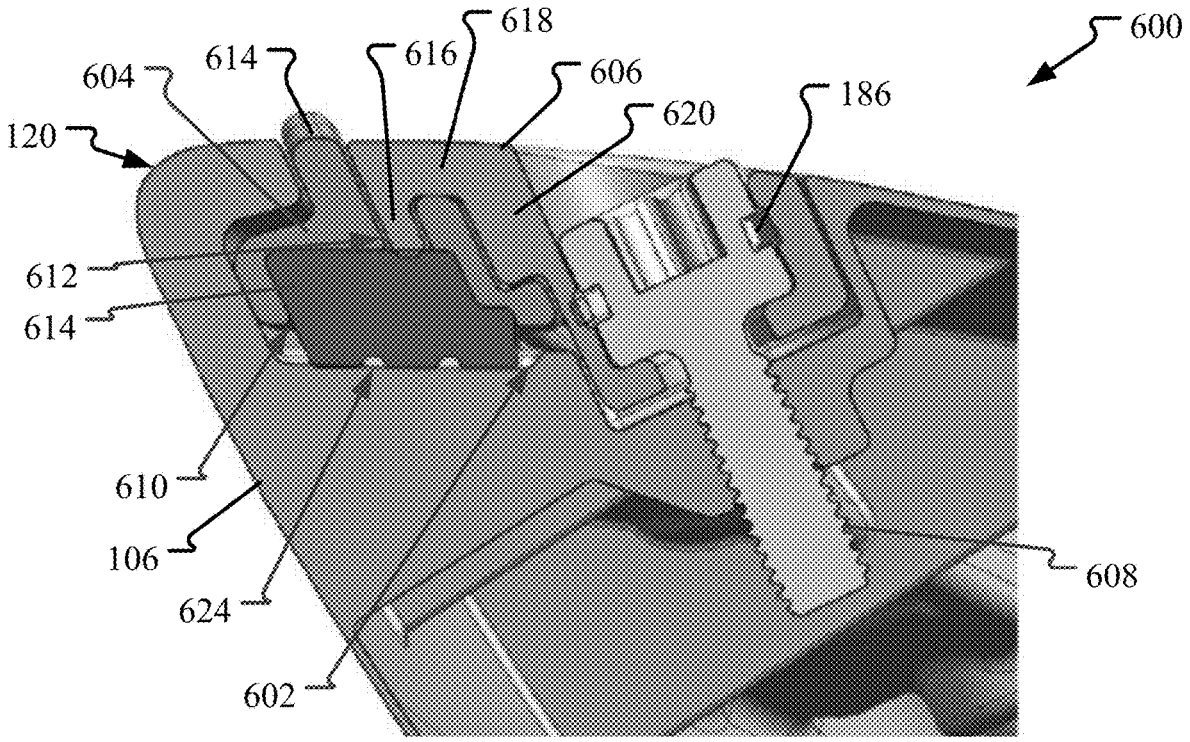
FIG. 16 is a cross-sectional view of the weight assembly taken along line 16-16 in FIG. 14.
Figure 17:
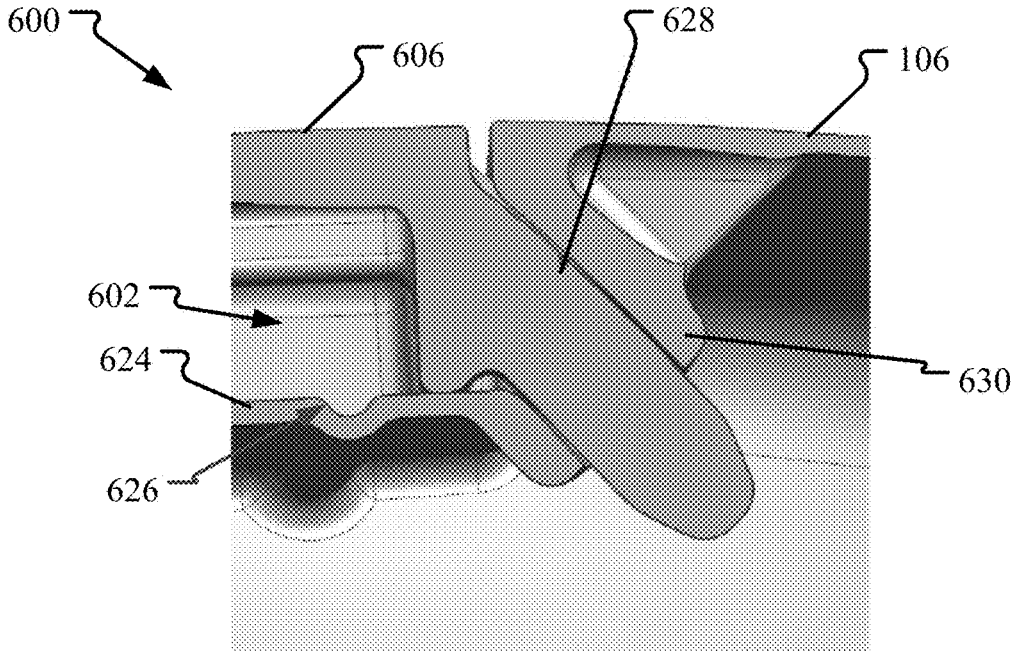
FIG. 17 is a cross-sectional view of the weight assembly taken along line 17-17 in FIG. 14.

FIG. 15 is a cross-sectional view of the club head 100 taken along line 15-15 in FIG. 14 and showing the weight assembly 600. FIG. 16 is a cross-sectional view of the weight assembly 600 taken along line 16-16 in FIG. 14. FIG. 17 is a cross-sectional view of the weight assembly 600 taken along line 17-17 in FIG. 14. Certain components are described above, and thus, are not necessarily described further. Referring concurrently to FIGS. 15-17, the weight assembly 600 is illustrated in a locked configuration and the weight 604 includes a bottom surface 610 and a groove 612. A tab 614 is disposed adjacent to the groove 612. Additionally, the weight 604 includes an elastomeric material 614. In this example, the elastomeric material 614 is coupled to the weight 604 and extends from the bottom surface 610 and also into the groove 612. The elastomeric material 614 is oversized relative to the channel 602 (e.g., between a 0.1 millimeter and 1.0 millimeter overlap) so that the material 614 may deform while being compressed within the channel 602. In other examples, the elastomeric material 614 may be adhered to the exterior surface of the weight 604. In yet other examples, the elastomeric material 614 may at least partially form the weight 604 itself.

The cover 606 is substantially C-shaped with a flange 616 that engages with the groove 612 of the weight 604. Additionally, the cover 606 includes a top leg 618 and a side leg 620 that is opposite of the flange 616. The top leg 618 has a thickness that is greater than the flange 616 and the side leg 620 so as to increase the structural rigidity of the cover 606 in a lengthwise direction. The fastener 608 is coupled to the cover 606 by a lock washer 186 that enables the fastener 608 to rotate relative to the cover 606 while allowing the cover 606 to move along a fastener axis 622 to raise and lower the cover 606 relative to the channel 602.

In operation, when the cover 606 is in the locked configuration, the flange 616 of the cover 606 is engaged within the groove 612 of the weight 604. This compresses the weight 604 between the cover 606 and a bottom track 624 of the channel 602. In the locked configuration, the elastomeric material 614 engages with both the cover 606 and the channel 602 to increase the securement of the weight 604 to one or more portion of the club head 100. In some examples, a plurality of grooves 626 are defined within the track 624 that the elastomeric material 614 deforms into the grooves 626 to facilitate securement of the weight 604 within the channel 602. Additionally, the tab 614 of the weight 604 may be positioned proximate the outer surface 120 of the body 106 so that the position of the weight 604 may be visible. When the weight assembly 600 is in the unlocked configuration (not shown), the cover 606 is lifted at least partially out of the channel 602 so that the weight 604 may be selectively slidable therein, for example, via the tab 614.

Each end of the cover 606 may include a substantially cylindrical projection 628 that is received within a corresponding cylindrical chamber 630 of the channel 602. The projections 628 extend along a projection axis 632 that is substantially parallel to the fastener axis 622. This orientation guides the movement of the cover 606 between the locked configuration and the unlocked configuration. In some examples, the projections 628 may include a tapered nose. Additionally, the chamber 630 may be open into the interior cavity 122 of the body 106 as illustrated in FIGS. 15 and 16. In other examples, the chamber 630 may be closed off from the interior cavity 122. One or more support ribs 634 may also extend from the track 624 and within the interior cavity 122 as required or desired.

Figure 18:
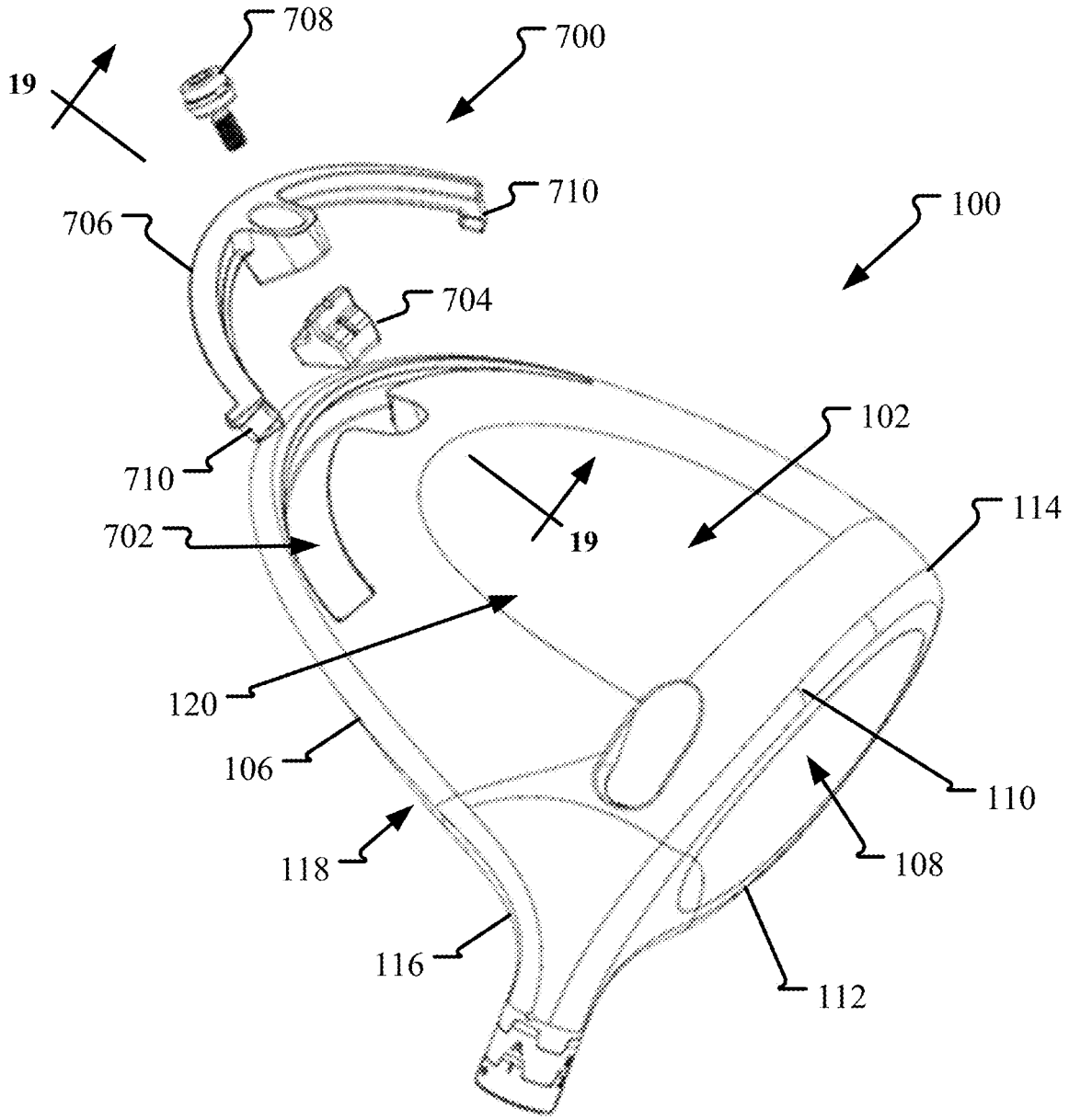
FIG. 18 is an exploded perspective view the golf club head with another weight assembly.

FIG. 18 is an exploded perspective view of the golf club head 100 with another weight assembly 700. Certain components are described above, and thus, are not necessarily described further. Similar to the example described in FIGS. 14-17, in this example, the weight assembly 700 includes a recessed channel 702 defined within the body 106 of the club head 100 and the channel 702 has a substantially curved shape in the toe 114-heel 116 direction. In some examples, the curve of the channel 702 matches the rear perimeter of the body 106, where the sole 102 and the crown 118 are coupled together. The weight assembly 700 also includes a slidable weight 704, a cover 706, and a fastener 708. At each end of the cover 706, projections 710 may extend for engagement within the channel 702.

Figure 19:
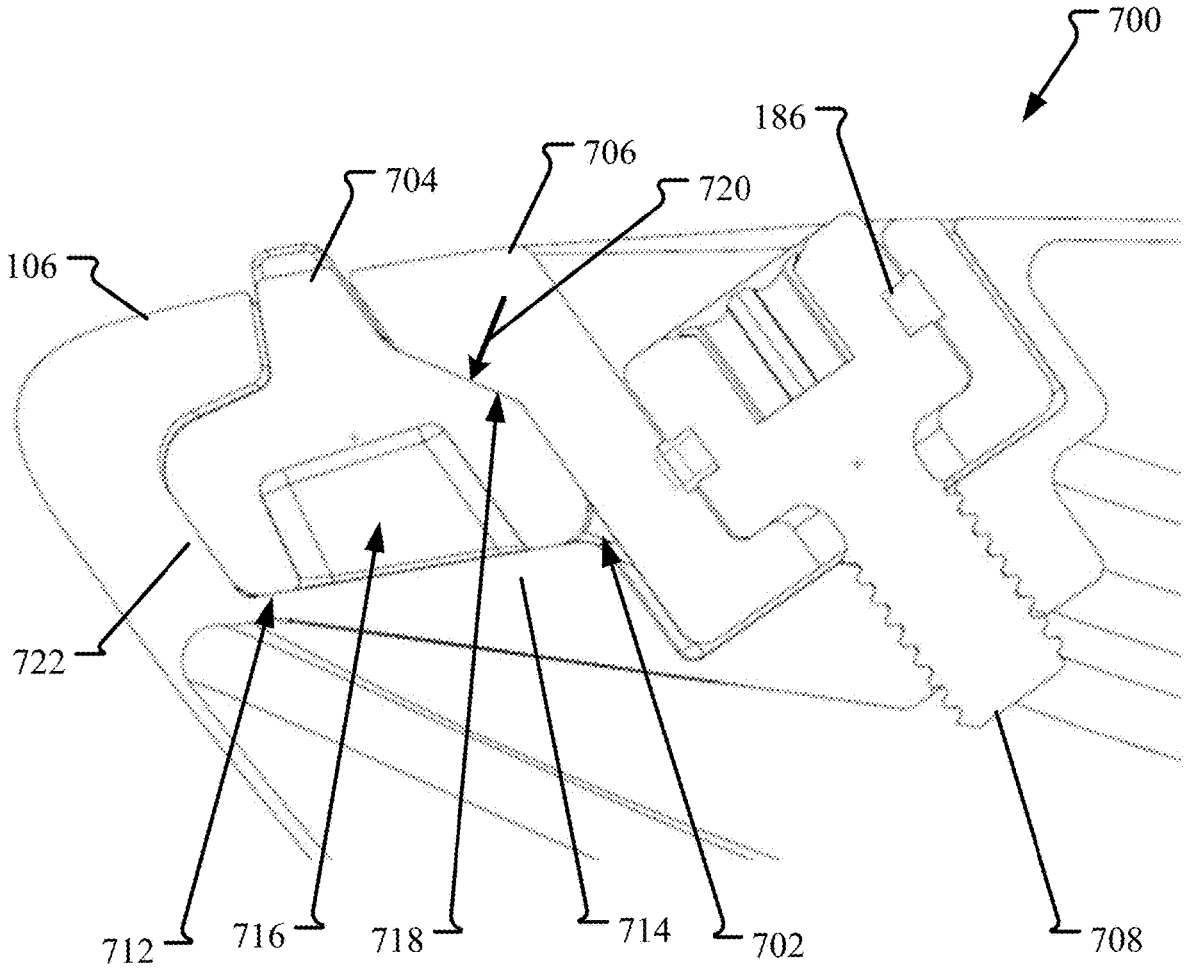
FIG. 19 is a cross-sectional view of the weight assembly taken along line 19-19 in FIG. 18.

FIG. 19 is a cross-sectional view of the weight assembly 700 taken along line 19-19 in FIG. 18. Certain components are described above, and thus, are not necessarily described further. The weight assembly 700 is illustrated in the locked configuration in FIG. 19 and a bottom surface 712 of the weight 704 is positioned directly against a track 714 of the channel 702. Additionally, in this example, the bottom surface 712 of the weight 704 includes a hollow 716. The hollow 716 reduces frictional sliding forces on the weight 704, when the weight assembly 700 is in the unlocked configuration (not shown). The hollow 716 also enables for the size and shape of the weight 704 to be formed while maintaining the required or desired mass and/or density of the weight 704. In some examples, an elastomeric material (not shown) may be disposed at least partially within the hollow 716.

Additionally, the cover 706 includes an angled surface 718 that abuts the weight 704. As such, when the weight assembly 700 is in a locked configuration (e.g., FIG. 19), the cover 706 generates a compressive force 720 along the angled surface 718 that acts in both a downward direction and a transverse direction to secure the weight 704 between the cover 706 and an undercut sidewall 722 of the channel 702. As such, the weight 704 is frictionally secured by the weight assembly 700 to one or more portions of the club head 100.

Figure 20:
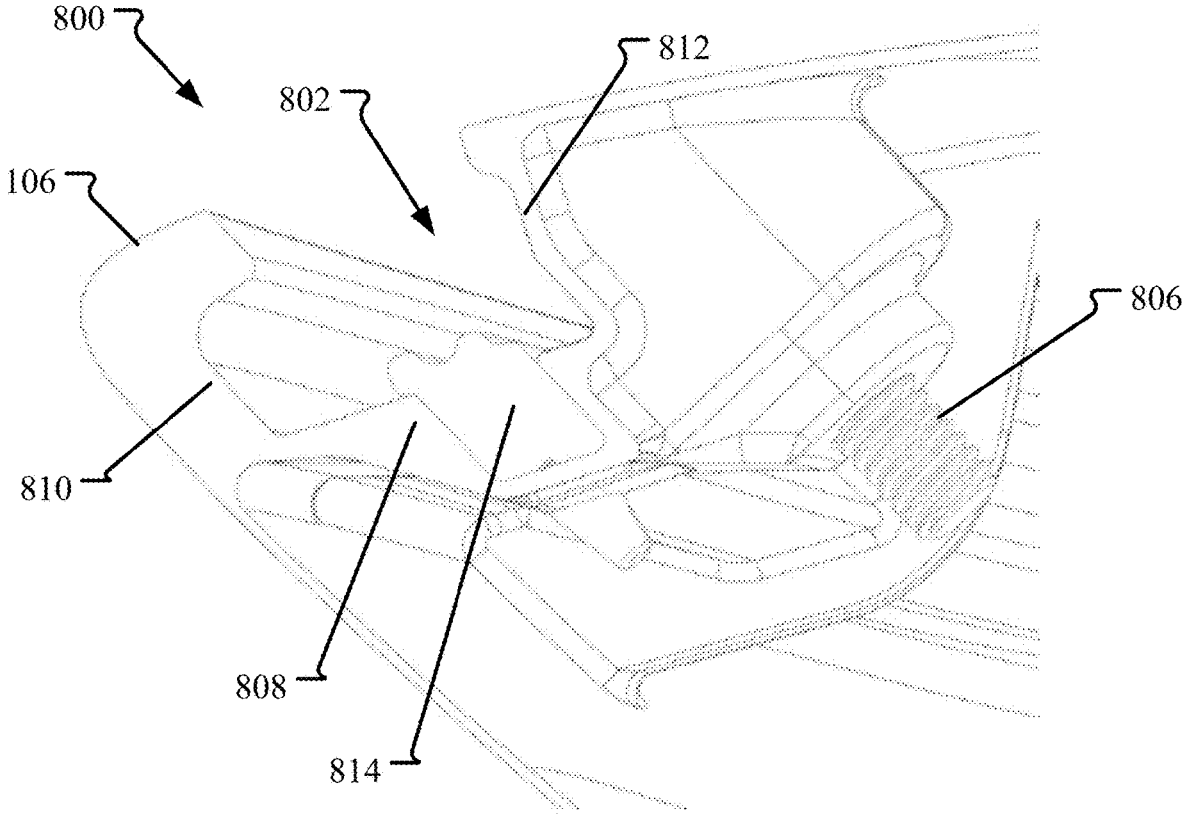
FIG. 20 is a partial cross-sectional perspective view of another weight assembly.
Figure 21:
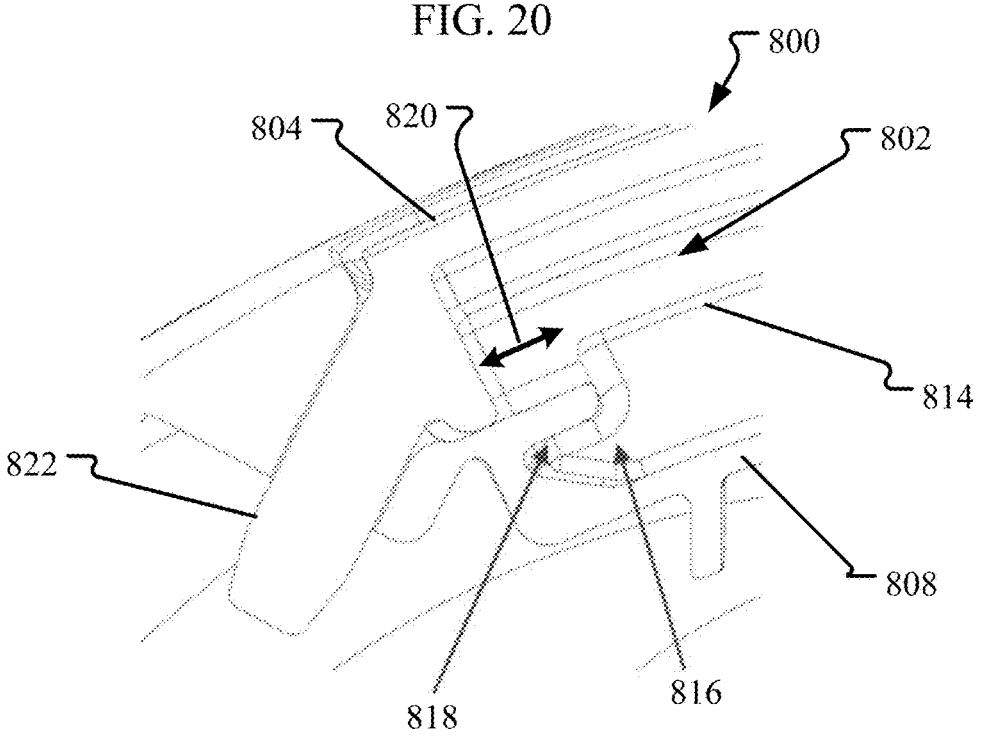
FIG. 21 is another cross-sectional view of the weight assembly shown in FIG. 20.

FIG. 20 is a partial cross-sectional perspective view of another weight assembly 800. FIG. 21 is another cross-sectional view of the weight assembly 800. Certain components are described above, and thus, are not necessarily described further. Referring concurrently to FIGS. 20 and 21, the cross-sectional views are substantially along a front-rear direction of the golf club head and, for example, similar to the examples described above in reference to FIGS. 16 and 17. The weight assembly 800 includes a recessed channel 802 defined within the body 106. The weight assembly 800 also includes a slidable weight (not shown), a cover 804, and a fastener 806. In this example, the channel 802 is defined by a bottom track 808 and two opposing sidewalls 810, 812. The bottom track 808 includes an elastomeric material 814 coupled thereto and that extends at least partially into the channel 802. The elastomeric material 814 engages with the weight and further increases securement of the weight within the channel 802 in the locked configuration. Additionally, the elastomeric material 814 decreases rattling of the weight during the swing of the club head. Additionally or alternatively, the elastomeric material 814 may be coupled to one or more of the sidewalls 810, 812 as required or desired. In still other examples, the elastomeric material 814 can be coupled to the cover 804.

In this example, the elastomeric material 814 extends along the longitudinal length of the channel 802. At each end 816 of the elastomeric material 814, a portion of the material may extend into an undercut area 818 within the channel 802 so as to secure the elastomeric material 814 within the channel 802. In other examples, the elastomeric material 814 may be adhered within the channel 802 or the cover 804 as required or desired. The end 816 of the elastomeric material 814 may be offset 820 from a projection 822 of the cover 804 so that the elastomeric material 814 does not interfere with the movement of the cover 804 between the locked and unlocked configurations as described herein.

Figure 22:
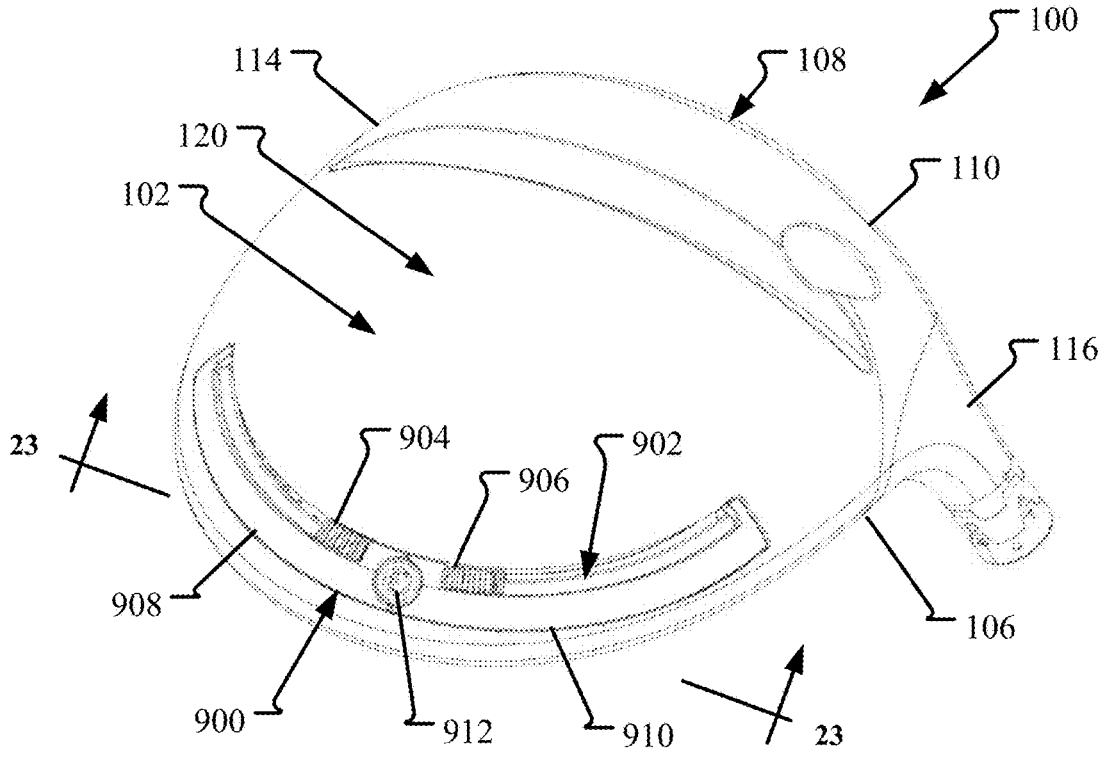
FIG. 22 is a perspective view of the sole of the golf club head with another weight assembly in a locked configuration.
Figure 23:
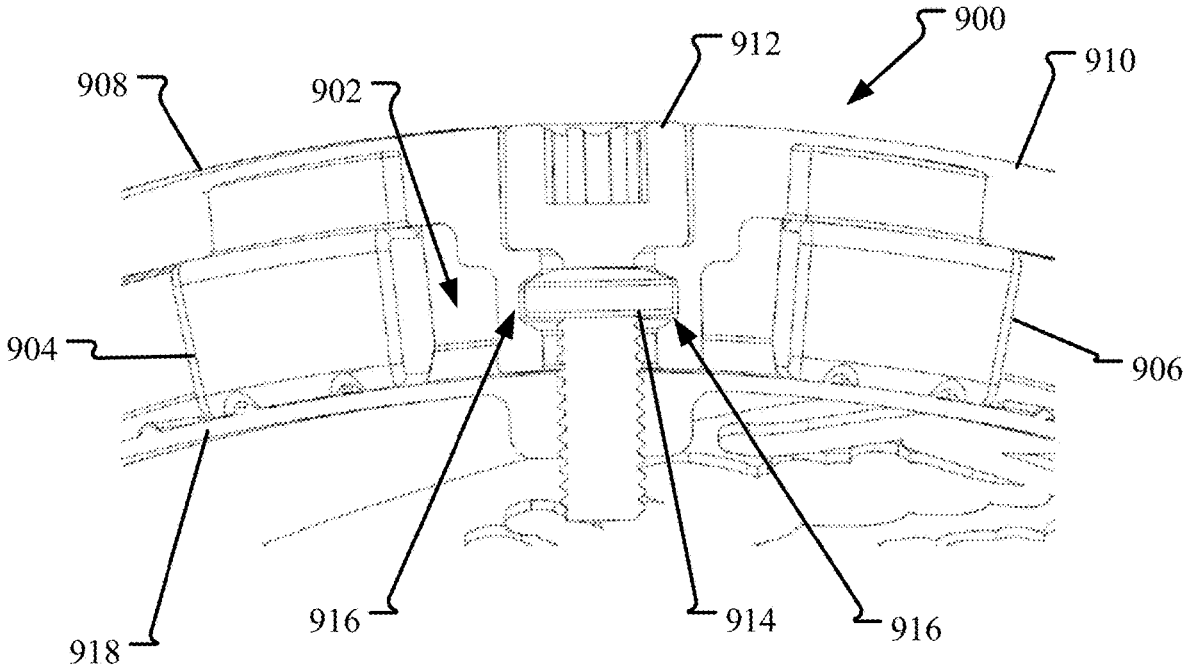
FIG. 23 is a cross-sectional view of the weight assembly taken along line 23-23 in FIG. 22.

FIG. 22 is a perspective view of the sole 102 of the golf club head 100 with another weight assembly 900 in a locked configuration. FIG. 23 is a cross-sectional view of the weight assembly 900 taken along line 23-23 in FIG. 22. Certain components are described above, and thus, are not necessarily described further. Referring concurrently to FIGS. 22 and 23, the weight assembly 900 is illustrated in a locked configuration and includes a recessed channel 902 defined within the sole 102 of the body 106 of the club head 100. The channel 902 has a substantially curved shape in the toe 114-heel 116 direction so that the GC and the MOI of the club head 100 can be adjustable for fade-drawn bias. In some examples, the curve of the channel 902 matches the rear perimeter of the body 106, where the sole 102 and the crown 118 are coupled together. The weight assembly 900 also includes a toe-side slidable weight 904, a heel-side slidable weight 906, a toe side cover 908, a heel side cover 910, and a fastener 912.

In this example, the fastener 912 is disposed within the channel 902 and divides the weight assembly 900 approximately in half. By positioning the fastener 912 within the channel 902 the size of the weight assembly 900 on the club head 100 is reduced. Additionally, the mass of the fastener 912 is moved further rearward from the striking face 108 than those examples described above. The weights 904, 906 extend from the inner convex side of the covers 908, 910 as illustrated in FIG. 22. In other examples, the weights 904, 906 may extend from the outer concave side of the covers 908, 910 as required or desired. In this example, two slidable weights 904, 906 are described since the fastener 912 prevents a weight from sliding completely from the toe side to the head side of the channel 902 and back. In some examples, the weight assembly 900 may include only one slidable weight and the fastener 912 and the covers 908, 910 are configured to allow the weight to pass between the toe 114 side and the heel 116 side. In other examples, the weight assembly 900 may include only one slidable weight that requires the assembly to be completely disassembled so as to move the weight from the toe side to the head side and back. In still other examples, the weights 904, 906 may be completely removable from the channel 902 as required or desired.

One end of each cover 908, 910 is engaged with the channel 902, for example, with the projection/channel interface as described herein, while the other opposite end of each cover 908, 910 is engaged with the fastener 912. In the example, the fastener 912 includes a washer 914 that is disposed below the head. The washer 914 is a substantially cylindrical flange extending from the threaded shaft that engages with both corresponding groove 916 within the covers 908, 910. When the weight assembly 900 is in the locked configuration the covers 908, 910 are disposed within the channel 902 and secured in place with the fastener 912, via the grooves 916, so that the weights 904, 906 cannot slide within the channel 902 and are locked in place. Additionally, the covers 908, 910 are flush with the outer surface 120 of the body 106. In some examples, the portion of the covers 908, 910 that define the grooves 916 may extend all the way to a bottom track 918 of the channel 902 so that overtightening of the fastener 912 is reduced or prevented.

Figure 24:
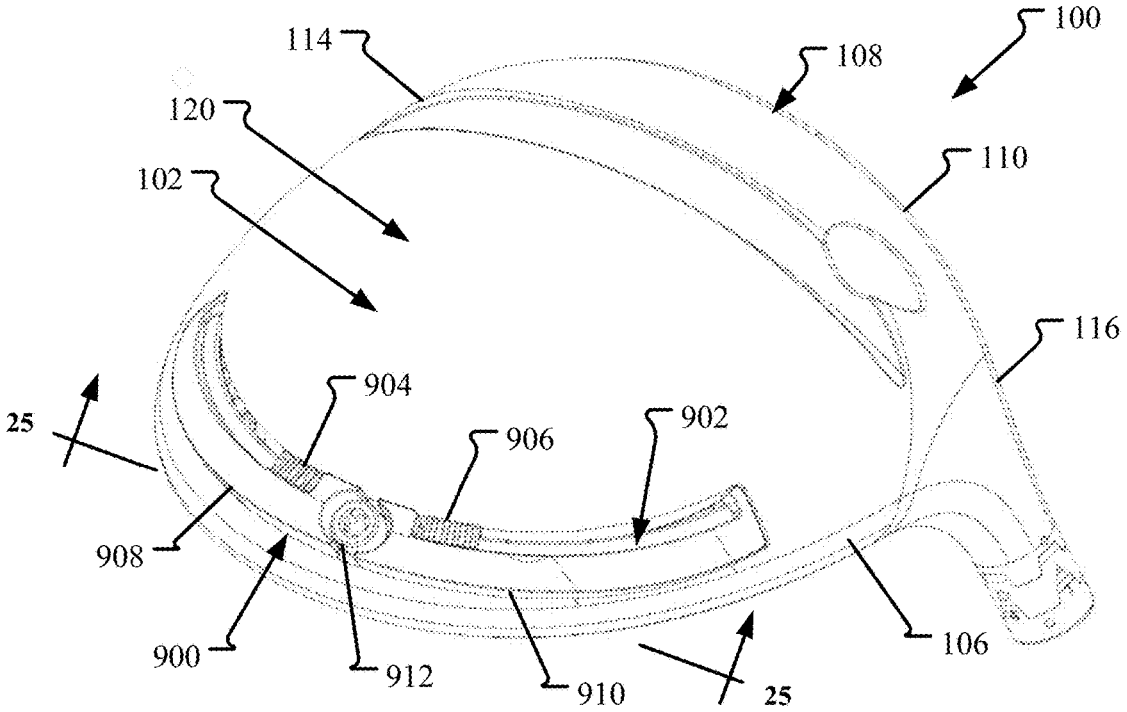
FIG. 24 is a perspective view of the sole of the golf club head with the weight assembly shown in FIG. 22 in an unlocked configuration.
Figure 25:
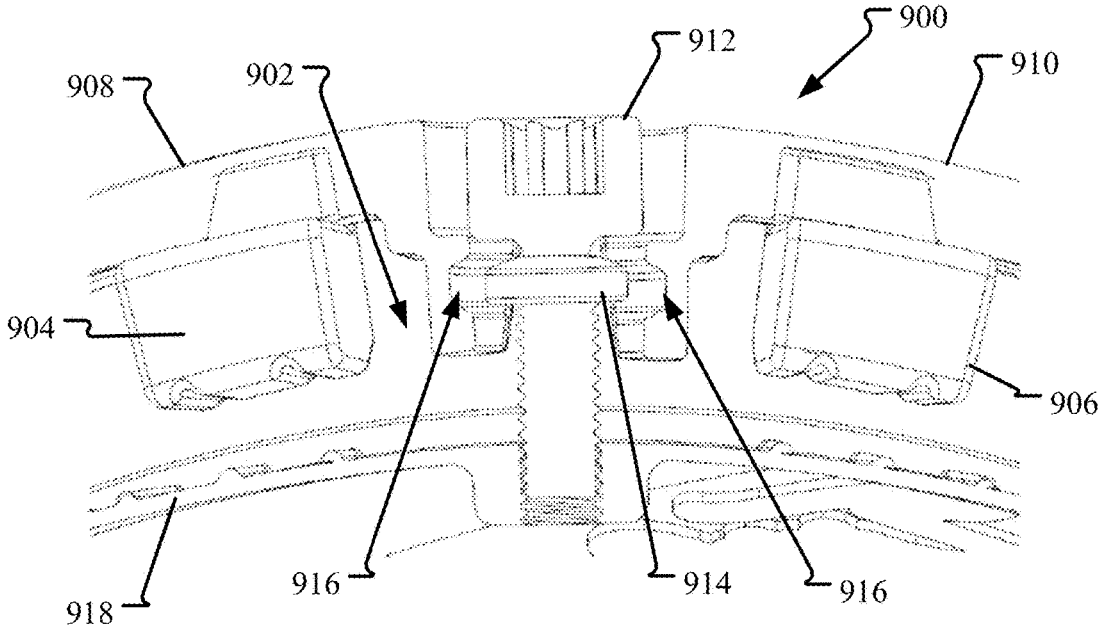
FIG. 25 is a cross-sectional view of the weight assembly taken along line 25-25 in FIG. 24.

FIG. 24 is a perspective view of the sole 102 of the golf club head 100 with the weight assembly shown 900 in an unlocked configuration. FIG. 25 is a cross-sectional view of the weight assembly 900 taken along line 25-25 in FIG. 24. Certain components are described above, and thus, are not necessarily described further. Referring concurrently to FIGS. 24 and 25, the weight assembly 900 is illustrated in an unlocked configuration. When the weight assembly 900 moves from the locked configuration (shown in FIGS. 22 and 23), the fastener 912 is rotated so as to lift at least partially out of the channel 902. This movement of the fastener 912 also lifts the ends of the covers 908, 910 that are engaged with the washer 914 at least partially out of the channel 902 so as to enable the weights 904, 906 to slide within the channel 902. In some examples, the weights 904, 906 may be engaged with the respective cover 908, 910 so as to lift away from the track 918 for ease of movement.

In some examples, the covers 908, 910 and the fastener 912 may be completely removed from the body 106 as required or desired so as to completely remove the weights 904, 906 from the channel 902. However, moving the weight assembly 900 between the locked configuration) and the unlocked configuration does not require that the weight assembly 900 be uncoupled from the body 106. As such, in the unlocked configuration, the covers 908, 910 remain coupled to the body 106 so that it is less likely that the components become lost or misplaced.

In this example, when the covers 908, 910 are in the unlocked configuration, the ends of the covers 908, 910 that are opposite of the fastener 912 and engaged with the channel 902 (e.g., with the projection/channel interface) remain engaged with the channel 902 and may form a pivot point that the covers 908, 910 rotate about. In other examples, the ends of the covers 908, 910 that are opposite of the fastener 912 may lift at least partially out of the channel 902 as described herein. For example, through a cam and cutout interface as described above.

Figure 26:
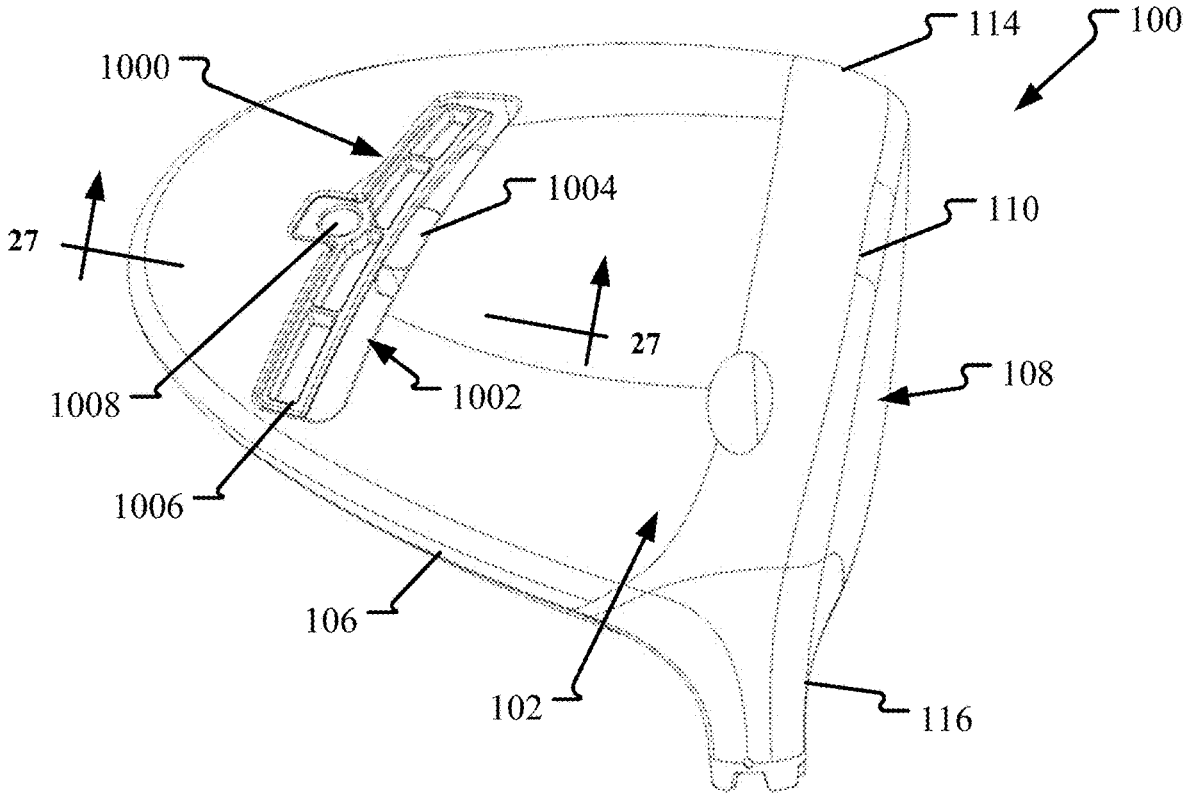
FIG. 26 is a perspective view of the sole of the golf club head with another weight assembly.
Figure 27:
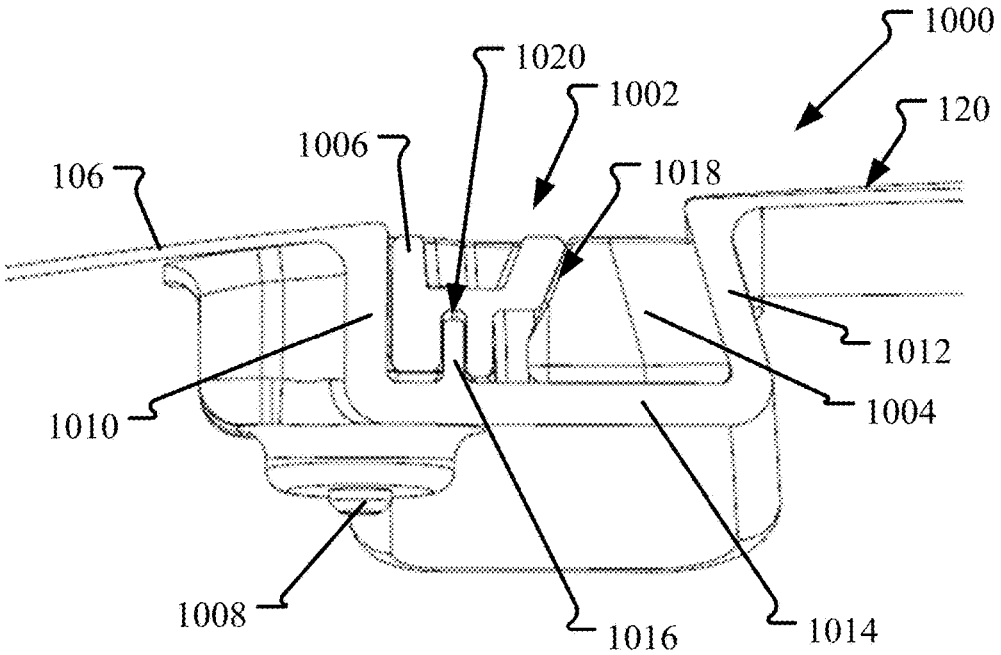
FIG. 27 is a cross-sectional view of the weight assembly taken along line 27-27 in FIG. 26.

FIG. 26 is a perspective view of the sole 102 of the golf club head 100 with another weight assembly 1000. FIG. 27 is a cross-sectional view of the weight assembly 1000 taken along line 27-27 in FIG. 26. Certain components are described above, and thus, are not necessarily described further. Referring concurrently to FIGS. 26 and 27, the weight assembly 1000 includes a substantially linear recessed channel 1002 defined within the sole 102. The weight assembly 1000 also includes a slidable weight 1004, a cover 1006, and a fastener 1008. In this example, the fastener 1008 may be positioned at approximately the midpoint of the channel 1002 and offset towards the rear of the club head 100. By positioning the fastener 1008 at a midpoint location, the distance between the fastener 1008 and the far end(s) of the cover 1006 is reduced so that the engagement between the cover 1006 and the channel 1002 is increased for securement of the weight 1004.

Similar to the example described above in reference to FIGS. 6 and 7, the channel 1002 is formed by two opposing sidewalls, a cover sidewall 1010 and an undercut sidewall 1012, and a bottom track 1014 offset from the outer surface 120 of the body 106. A partial wall 1016 also extends from the bottom track 1014. The cover 1006 is located adjacent to the cover sidewall 1010 and includes an angled surface 1018. As such, when the weight assembly 1000 is in a locked configuration (e.g., FIG. 27), the cover 1006 generates a compressive force along the angled surface 1018 that acts in both a downward direction and a transverse direction to secure the weight 1004 between the cover 1006 and the undercut sidewall 1012. Accordingly, the weight 1004 is frictionally secured by the weight assembly 1000 and at least partially underneath the angled surface 1018 and the undercut sidewall 1012. Additionally, the cover 1006 completely engages with the partial wall 1016 via a groove 1020 so that the portion of the cover 1006 away from the fastener 1008 is restricted from moving within the channel 1002 (e.g., bending or flexing) towards the undercut sidewall 1012. Furthermore, the partial wall 1016 is substantially parallel to the fastener axis (not shown) of the fastener 1008 so that the cover 1006 guides the movement between the locked and unlocked configuration.

Figure 28:
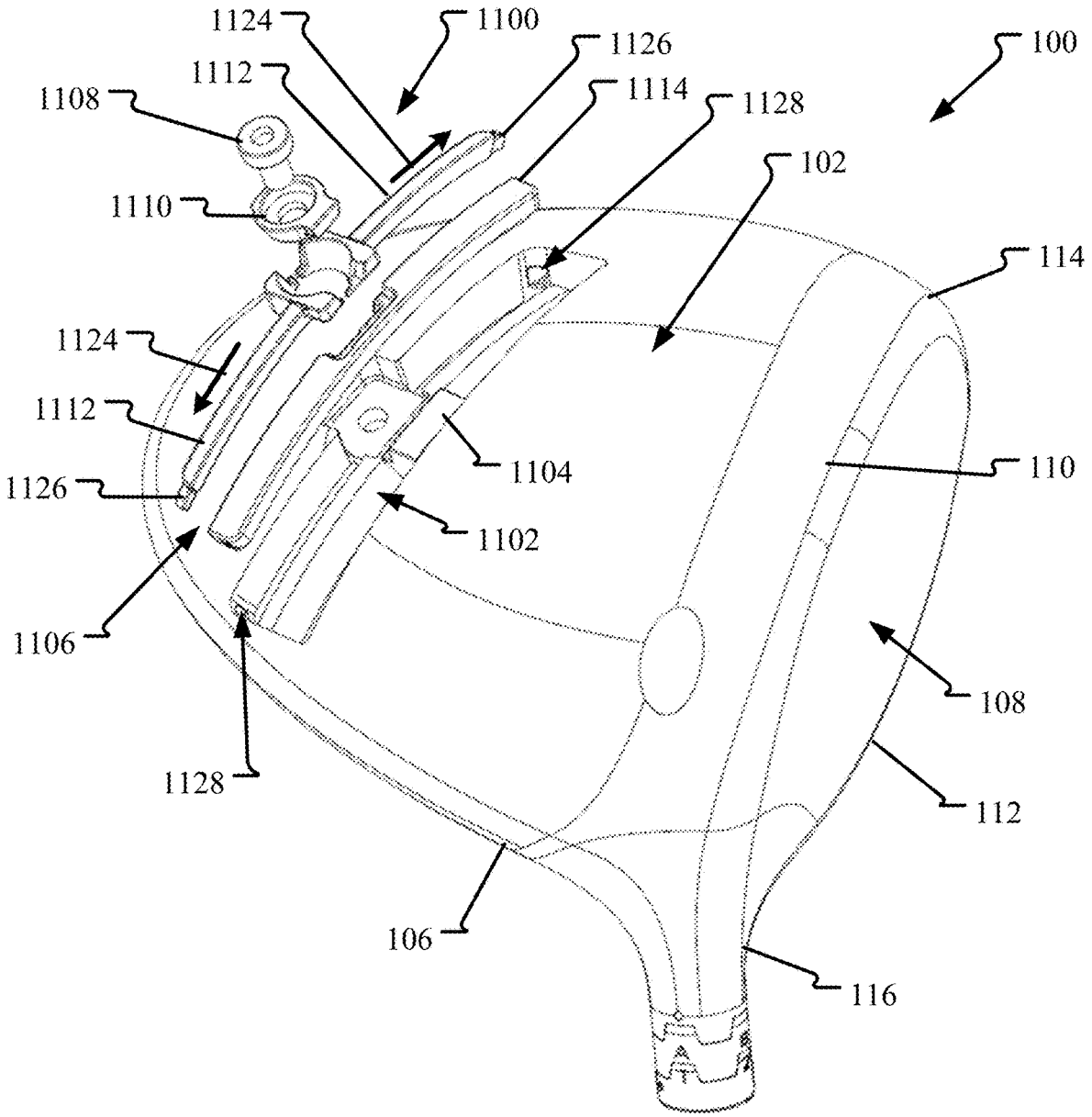
FIG. 28 is an exploded perspective view of the sole of the golf club head with another weight assembly.
Figure 29:
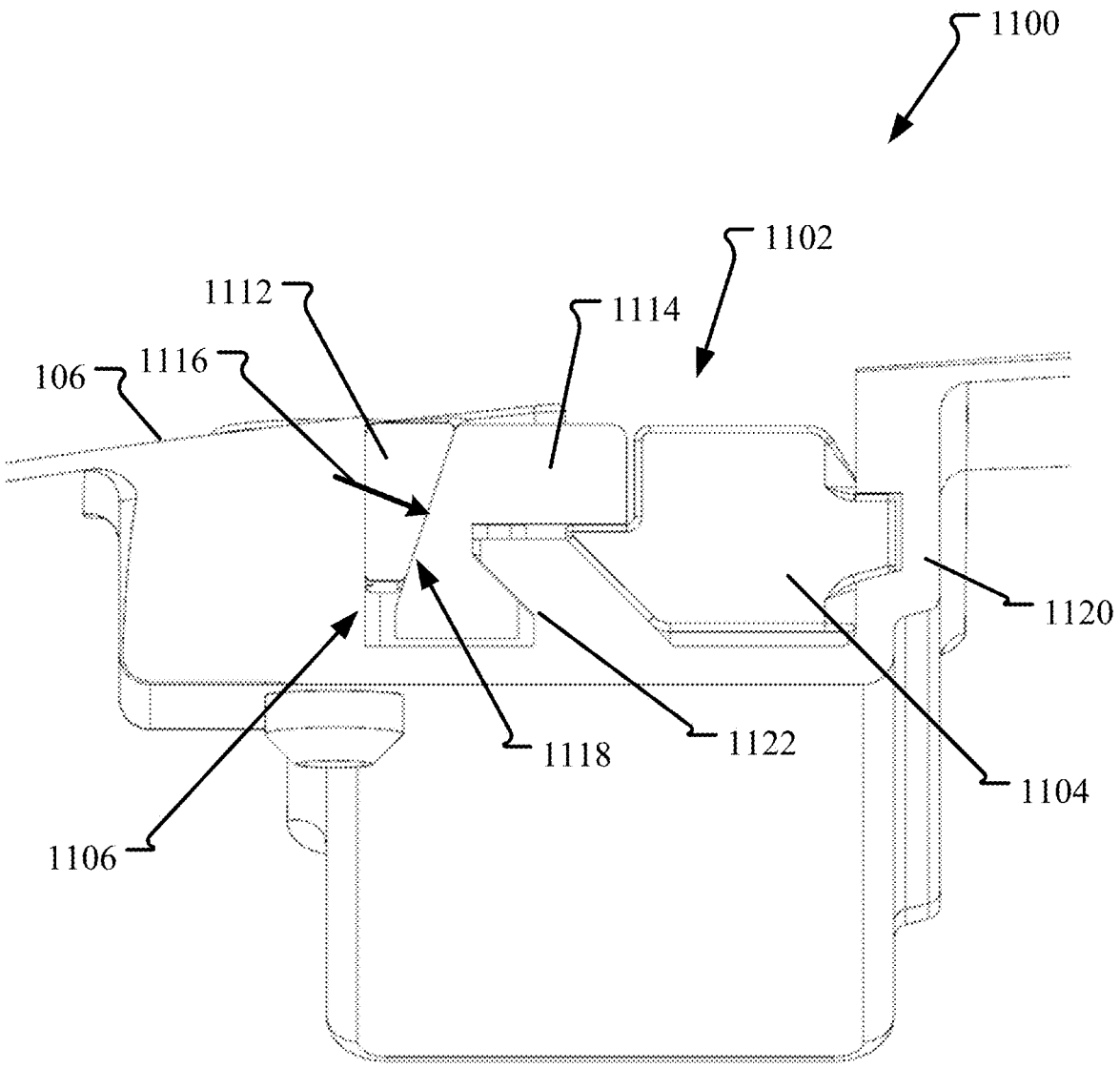
FIG. 29 is a cross-sectional view of the weight assembly shown in FIG. 28.

FIG. 28 is an exploded perspective view of the sole 102 of the golf club head 100 with another weight assembly 1100. FIG. 29 is a cross-sectional view of the weight assembly 1100. Certain components are described above, and thus, are not necessarily described further. Referring concurrently to FIGS. 28 and 29, the weight assembly 1100 includes a substantially linear recessed channel 1102 defined within the sole 102. The weight assembly 1100 also includes a slidable weight 1104, a cover assembly 1106, and a fastener 1108. In this example, the fastener 1108 may be positioned at approximately the midpoint of the channel 1102 and offset towards the rear of the club head 100. As described above, when the cover assembly 1106 is in the locked configuration, the cover assembly 1106 is coupled to the body 106 so that the weight 1104 is be secured within the weight assembly 1100 without movement or rattling. In this example, the cover assembly 1106 is a four piece assembly including a fastener member 1110, two opposing longitudinal members 1112, and a transverse member 1114.

When the cover assembly 1106 is moved towards the locked configuration (e.g., FIG. 29), the fastener 1108 is tightened to the body 106. The fastener 1108 engages with the fastener member 1110 and moves the fastener member 1110 along the fastener axis (not shown) and into the channel 1102. The fastener member 1110 has a tapered surface that engages with both of the longitudinal members 1112 so that as the fastener member 1110 is pulled down within the channel 1102, the longitudinal members 1112 are also pulled down within the channel 1102 and generate a compressive force 1116 along an angled surface 1118. The compressive force 1116 acts in both a downward direction and a transverse direction on the transverse member 1114 to position the transverse member 1114 within the channel 1102 and compress the weight 1104 between the transverse member 1114 and a sidewall 1120 of the channel.

Additionally, to reduce or prevent pull-out of the weight assembly 1100 from the body 106, the transverse member 1114 may engage with an undercut 1122 of the channel 1102. The compressive force 1116 from the longitudinal members 1112 lock the transverse member against the undercut 1122 so as to prevent movement. Additionally or alternatively, a portion of the weight 1104 may engage with the sidewall 1120 of the channel 1102 so as to reduce pull out of the weight assembly 1100 from the body 106. Additionally, the fastener member 1110 also pushes the longitudinal members 1112 away from the fastener 1108 (e.g., arrows 1124) so that ends 1126 of the members 1112 can engage with a corresponding chamber 1128 in the channel 1102 and also reduce pull out of the weight assembly 1100 from the body 106.

Figure 30:
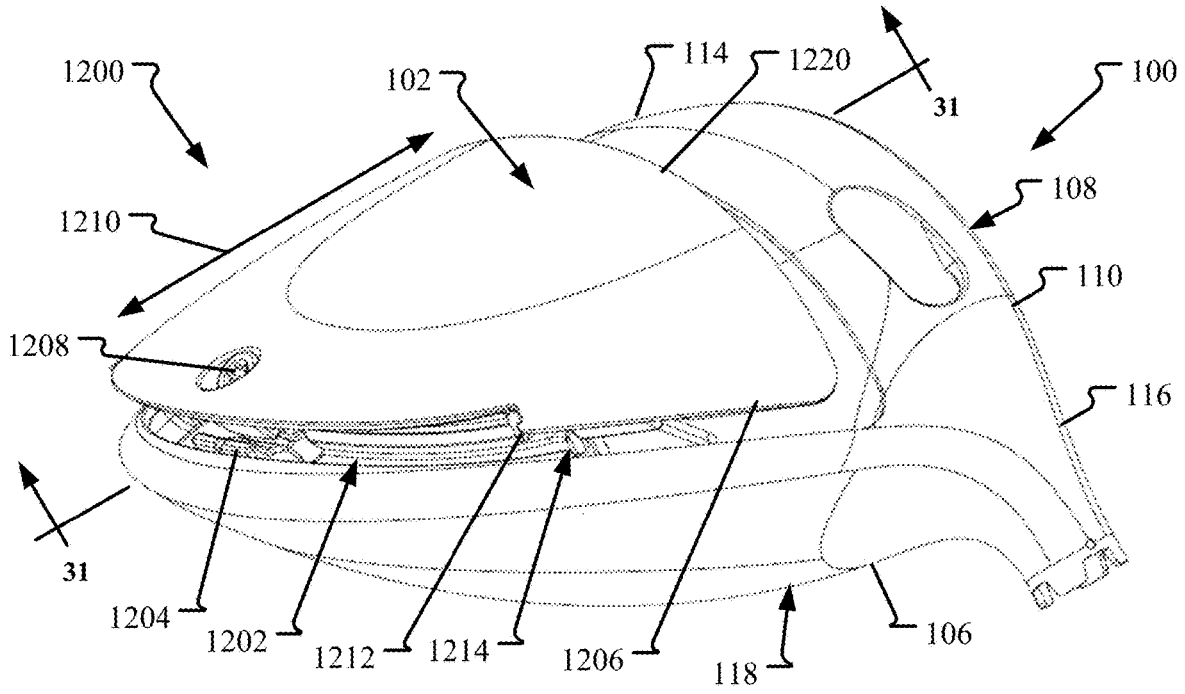
FIG. 30 is a perspective view of the sole of the golf club head with another weight assembly.
Figure 31:
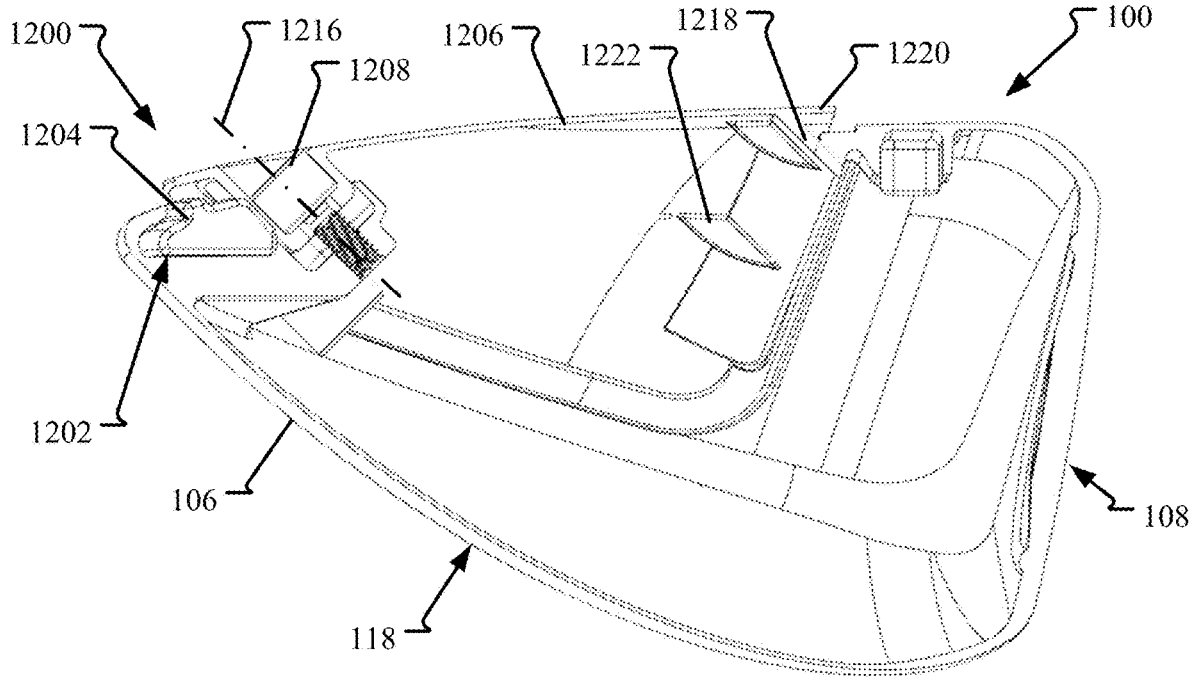
FIG. 31 is a cross-sectional view of the weight assembly taken along line 31-31 in FIG. 30.

FIG. 30 is a perspective view of the sole 102 of the golf club head 100 with another weight assembly 1200. FIG. 31 is a cross-sectional view of the weight assembly 1200 taken along line 31-31 in FIG. 30. Certain components are described above, and thus, are not necessarily described further. Referring concurrently to FIGS. 30 and 31, the weight assembly 1200 is illustrated in an unlocked configuration and includes a recessed channel 1202, a slidable weight 1204, a cover 1206, and a fastener 1208. The structure, size, shape, and orientation of the channel 1202, the weight 1204, and the fastener 1208 may be similar to any of the examples described above. In this example, however, a width 1210 of the cover 1206 is extended towards the striking face 108 so that the cover 1206 forms a greater portion of the sole 102 and does not only cover a portion of the channel 1202.

In some examples, the cover 1206 may form greater than or equal to 75% of the surface area of the sole 102. In other examples, the cover 1206 may form greater than to equal to 50% of the surface area of the sole 102. In still other examples, the cover 1206 may form greater than or equal to 25% of the surface area of the sole 102. In still further examples, the cover 1206 may be between about 10% and 90% of the surface area of the sole 102. In other examples, the cover 1206 may be between about 25% and 75% of the surface area of the sole 102.

By enlarging the cover 1206 of the weight assembly 1200, the golf club head structure that forms the sole 102 of the body 106 can be reduced. In some examples, the cover 1206 can be manufactured from a lighter weight material (e.g., composite materials, plastics, etc.) than the material that the body 106 is manufactured from. As such, the weight saved by the configuration of the sole construction can be used at other locations on the club head 100 as required or desired and further enable adjustment of the GC and MOI of the club head 100 for improving golf ball flight characteristics. In some examples, the weight saved by the sole construction can be included back into the slidable weight 1204. For example, the cover 1206 may reduce the weight of the sole construction by 11 grams or more, some or all of which mass that can then be included at least partially into the weight 1204.

The cover 1206 can include a projection 1212 extending therefrom that is configured to engage with a corresponding chamber 1214 within each end of the channel 1202 for increasing the structural rigidity of the cover 1206 connection as described in the examples above. In one example, the projection 1212 may be substantially cylindrical and parallel to a fastener axis 1216. At the opposite side of the cover 1206 from the fastener 1208, the cover 1206 includes a brace 1218 adjacent to an extended edge 1220 that frictionally engages with the remaining sole 102 of the club head 100 to secure the edge 1220 to the body 106. In some examples, the brace 1218 may extend at an angle that is substantially parallel to the fastener axis 1216 so as to guide the movement of the cover 1206 between the locked and unlocked configurations as described herein. The brace 1218 may include one or more brackets 1222 for increasing the structural rigidity of the brace 1218.

Figure 32:
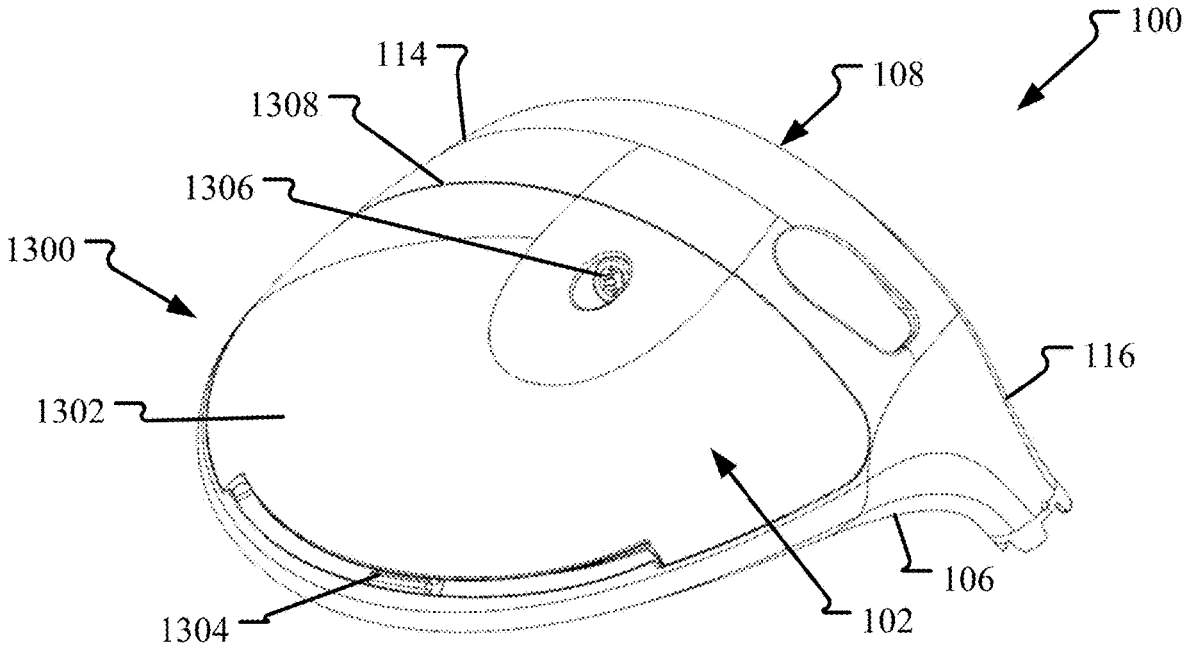
FIG. 32 is a perspective view of the sole of the golf club head with another weight assembly.

FIG. 32 is a perspective view of the sole 102 of the golf club head 100 with another weight assembly 1300. Certain components are described above, and thus, are not necessarily described further. Similar to the example described in FIGS. 30 and 31, the weight assembly 1300 includes an enlarged cover 1302 that selectively secures a slidable weight 1304 to one or more portions of the club head 100. In this example, however, a fastener 1306 is positioned more towards the striking face 108 and adjacent to an extended edge 1308 of the cover 1302. This example increases the securement of the edge 1308 to the body 106 of the golf club head 100. In other examples, the fastener 1306 may be positioned at any other location on the cover 1302 as required or desired. For example, towards the toe side 114, towards the heal side 116, centered on the cover 1302, etc.

Figure 33:
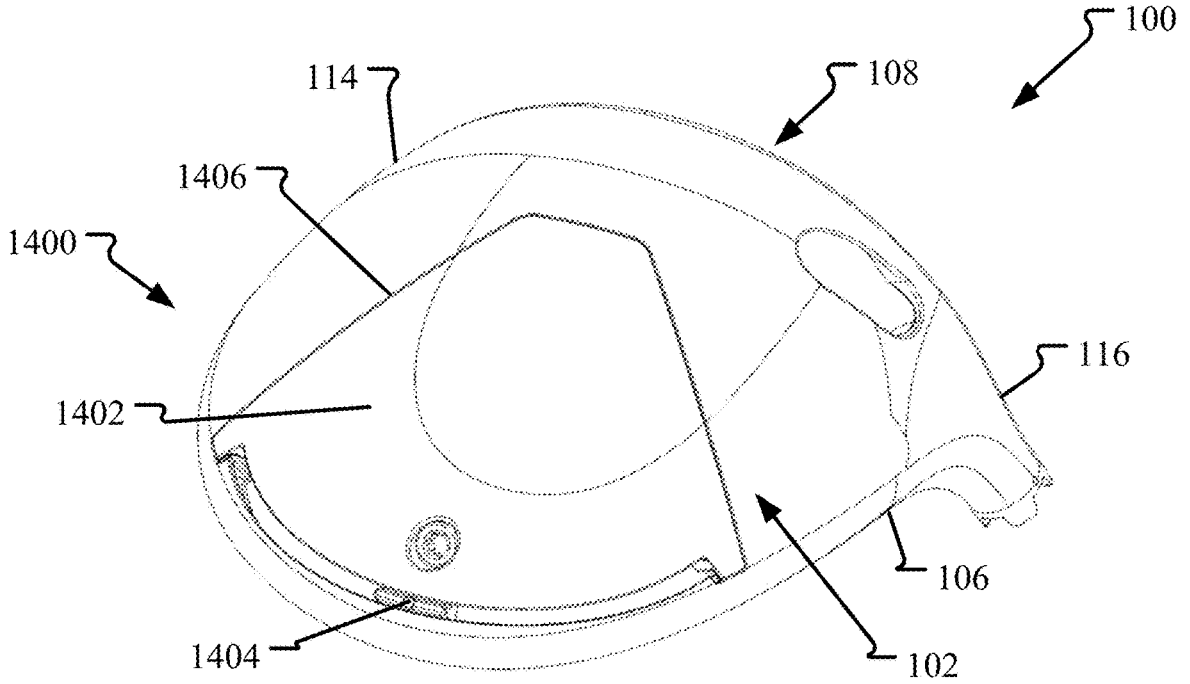
FIG. 33 is a perspective view of the sole of the golf club head with another weight assembly.

FIG. 33 is a perspective view of the sole 102 of the golf club head 100 with another weight assembly 1400. Certain components are described above, and thus, are not necessarily described further. Similar to the example described in FIGS. 30-32, the weight assembly 1400 includes an enlarged cover 1402 that selectively secures a slidable weight 1404 to one or more portions of the club head 100. In this example, however, the cover 1402 has an extended edge 1406 that is substantially V-shaped. Additionally, the cover 1402 is symmetrical in the toe 114-heel 116 direction. In other examples, the cover 1402 may be asymmetrical in the toe 114-heel 116 direction as required or desired.

Figure 34:
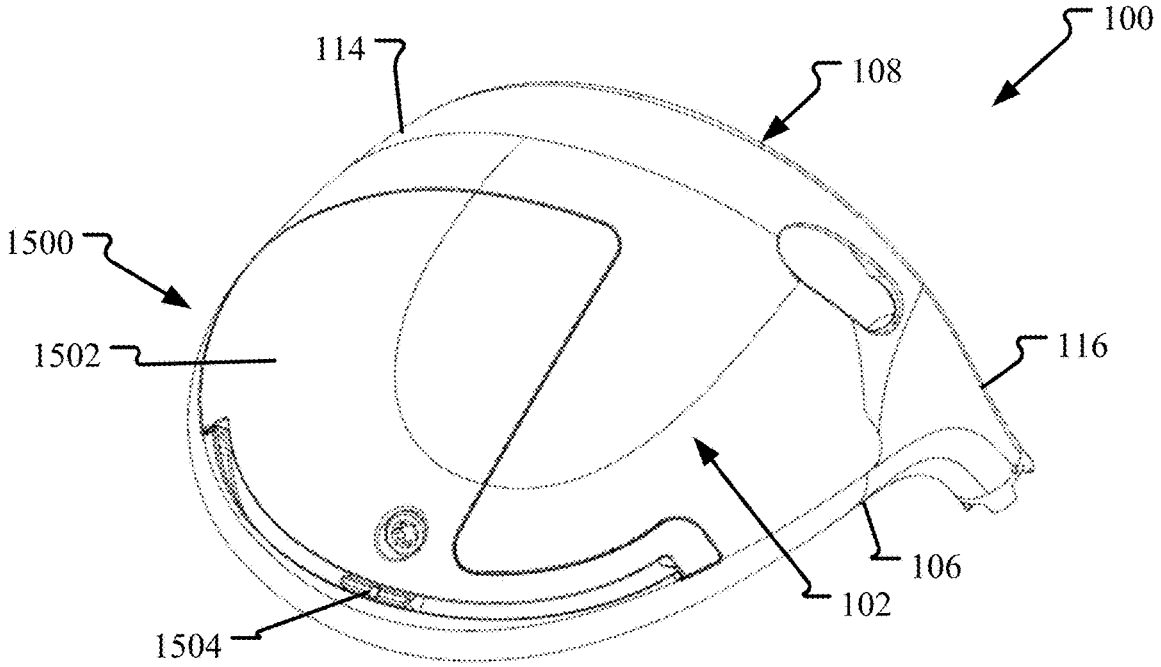
FIG. 34 is a perspective view of the sole of the golf club head with another weight assembly.

FIG. 34 is a perspective view of the sole 102 of the golf club head 100 with another weight assembly 1500. Certain components are described above, and thus, are not necessarily described further. Similar to the example described in FIGS. 30-33, the weight assembly 1500 includes an enlarged cover 1502 that selectively secures a slidable weight 1504 to one or more portions of the club head 100. In this example, however, the cover 1502 is asymmetrical in the toe side 114 direction. In other examples, the cover 1502 may be asymmetrical in the heel side 116 direction as required or desired.

Figure 35:
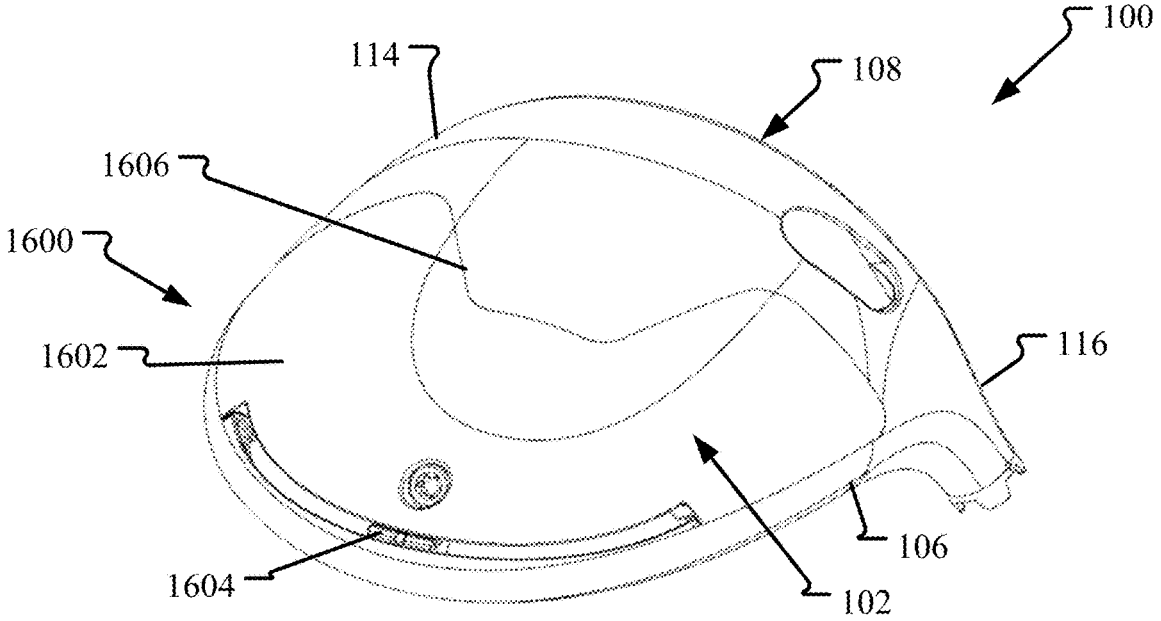
FIG. 35 is a perspective view of the sole of the golf club head with another weight assembly.

FIG. 35 is a perspective view of the sole 102 of the golf club head 100 with another weight assembly 1600. Certain components are described above, and thus are not necessarily described further. Similar to the example described in FIGS. 30-34, the weight assembly 1600 includes an enlarged cover 1602 that selectively secures a slidable weight 1604 to one or more portions of the club head 100. In this example, however, the cover 1602 has an extended edge 1606 that is substantially C-shaped. Additionally, the cover 1602 is symmetrical in the toe 114-heel 116 direction. In other examples, the cover 1602 may be asymmetrical in the toe 114-heel 116 direction as required or desired.

Although specific embodiments and aspects were described herein and specific examples were provided, the scope of the technology is not limited to those specific embodiments and examples. For instance, while many of the present examples have been depicted for use with a driver, the present technology may be applied to any metal wood, fairway metal or wood, or hybrid golf club. Further, each of the above examples may be combined with another and/or one or more features of some examples may be combined with other examples. One skilled in the art will recognize other embodiments or improvements that are within the scope and spirit of the present technology. Therefore, the specific structure, acts, or media are disclosed only as illustrative embodiments. In addition, if the limits of the terms "about," "substantially," or "approximately" as used in the following claims are unclear from the foregoing specification to one having skill in the art, those terms shall mean within ten percent of the value described. The scope of the technology is defined by the following claims and any equivalents therein.

What is claimed is:

1. A golf club head comprising:

a body comprising:

a striking face comprising a lower edge and an opposite upper edge;

a sole extending from the lower edge; and a crown extending from the upper edge, wherein one or more of the striking face, the sole, and the crown, define an outer surface of the body;

a recessed channel formed in the outer surface, wherein the recessed channel comprises one or more chambers; and a weight assembly comprising:

one or more weights at least partially disposed within the recessed channel;

a cover extending at least partially over the recessed channel, wherein the cover comprises one or more projections; and a fastener coupling the cover to the body, wherein the fastener is adapted to retain the one or more weights in the recessed channel only indirectly by the cover, wherein the weight assembly is positionable in at least an unlocked configuration and a locked configuration, and when the weight assembly is in the unlocked configuration, at least a portion of the cover is lifted out of the recessed channel and the one or more weights are selectively slidable within the recessed channel, and when the weight assembly is in the locked configuration, the cover is disposed within the recessed channel, the one or more weights are secured within the recessed channel, and the one or more projections are engaged within the one or more chambers, and wherein the weight assembly is coupled to the body in both the unlocked configuration and the locked configuration.

2. The golf club head of claim 1, wherein the recessed channel defines a track that the one or more weights are slidable on, and wherein the fastener is offset from the track.

3. The golf club head of claim 1, wherein the one or more projections are substantially cylindrical, and wherein the one or more cylindrical projections are substantially parallel to the fastener.

4. The golf club head of claim 1, wherein the recessed channel comprises one or more cams protruding into the recessed channel, and the cover comprises one or more corresponding cutouts, and wherein when the weight assembly is in the unlocked configuration, at least a portion of the cover is supported on the one or more cams, and when the weight assembly is in the locked configuration, the one or more cams are received at least partially within the one or more cutouts.

5. The golf club head of claim 1, wherein the recessed channel comprises one or more seats protruding into the recessed channel, and the cover comprises one or more corresponding notches, and wherein when the weight assembly is in the locked configuration, the one or more seats are engaged with the one or more notches.

6. The golf club head of claim 5, wherein the one or more seats comprise at least one oblique surface, and wherein the at least one oblique surface is substantially parallel to the fastener.

7. The golf club head of claim 1, wherein the body comprises an interior cavity and one or more support ribs extend within the interior cavity from the recessed channel.

8. The golf club head of claim 1, wherein the recessed channel is defined by a plurality of sidewalls, and wherein when the weight assembly is in the locked configuration, the one or more weights are compressed between at least one of the plurality of sidewalls and the at least one cover.

9. The golf club head of claim 1, wherein the cover comprises at least about 50% of the sole of the golf club head.

10. The golf club head of claim 1, wherein the one or more weights are slidably engaged with the cover.

11. A golf club head comprising:

a body comprising:

a striking face comprising a lower edge and an opposite upper edge;

a sole extending from the lower edge; and a crown extending from the upper edge, wherein one or more of the striking face, the sole, and the crown, define an outer surface of the body;

a recessed channel formed in the outer surface; and one or more weights at least partially disposed within the recessed channel;

two covers extending at least partially over the recessed channel; and a fastener coupling the two covers to the body, wherein the fastener is adapted to retain the one or more weights in the recessed channel only indirectly by the two covers, wherein the fastener comprises a washer, and wherein each cover has a first end engaged with the recessed channel and a second end engaged with the washer, wherein the fastener is positionable in at least an unlocked configuration and a locked configuration, and when the fastener is in the unlocked configuration, at least a portion of the two covers are lifted out of the recessed channel and the one or more weights are selectively slidable within the recessed channel, and when the fastener is in the locked configuration, the two covers are disposed within the recessed channel and the one or more weights are secured within the recessed channel, and wherein the fastener is coupled to the body in both the unlocked configuration and the locked configuration.

12. A golf club head comprising:

a striking face comprising a lower edge and an opposite upper edge;

a sole extending from the lower edge;

a crown extending from the upper edge, wherein one or more of the striking face, the sole, and the crown, define an outer surface of the golf club head;

a recessed channel formed in the outer surface and defined by a plurality of walls;

one or more weights at least partially disposed within the recessed channel, wherein the one or more weights comprise a groove; and at least one cover coupled to the golf club head and extending at least partially over the recessed channel, wherein a flange extends from the at least one cover, wherein at least a portion of the flange of the at least one cover is received at least partially within the groove of the one or more weights, wherein the one or more weights comprise an elastomeric material or one or more of the plurality of walls of the recessed channel comprise an elastomeric material, and wherein the at least one cover is positionable in at least an unlocked configuration and a locked configuration, and when the at least one cover is in the unlocked configuration, the one or more weights are selectively slidable within the recessed channel, and when the at least one cover is in the locked configuration, the one or more weights are secured within the recessed channel.

13. The golf club head of claim 12, wherein at least a portion of the one or more weights form a portion of the outer surface of the golf club head.

14. The golf club head of claim 12, wherein when the at least one cover is in the unlocked configuration, at least a portion of the at least one cover is raised out of the recessed channel, and when the at least one cover is in the locked configuration, the at least one cover is disposed within the recessed channel, and wherein the one or more weights moves with the at least one cover between the unlocked configuration and the locked configuration.

15. The golf club head of claim 12, wherein the one or more weights comprise the elastomeric material.

16. The golf club head of claim 15, wherein when the at least one cover is in the locked configuration, the elastomeric material at least partially deforms.

17. The golf club head of claim 15, wherein when the at least one cover is in the locked configuration, the at least one cover and the recessed channel engages with the elastomeric material.

18. The golf club head of claim 12, wherein one or more of the plurality of walls of the recessed channel comprise the elastomeric material.

19. The golf club head of claim 12, wherein when the at least one cover is in the unlocked configuration, at least a portion of the at least one cover is raised out of the recessed channel, and when the at least one cover is in the locked configuration, the at least one cover is disposed within the recessed channel, and wherein the one or more weights rotate within the recessed channel when the at least one cover moves between the unlocked configuration and the locked configuration.

20. The golf club head of claim 12, wherein the recessed channel comprises one or more chambers, and the cover comprises one or more corresponding projections, and wherein when the at least one cover is in the locked configuration, the one or more projections are engaged within the one or more chambers.

* * * * *